US011289016B2

(12) United States Patent
Kim et al.

(10) Patent No.: US 11,289,016 B2
(45) Date of Patent: Mar. 29, 2022

(54) DISPLAY DEVICE AND DRIVING METHOD THEREFOR

(71) Applicants: LG ELECTRONICS INC., Seoul (KR); INDUSTRY-UNIVERSITY COOPERATION FOUNDATION HANYANG UNIVERSITY, Seoul (KR)

(72) Inventors: Sunghwan Kim, Seoul (KR); Seongjin Park, Seoul (KR); Oh-Kyong Kwon, Seoul (KR)

(73) Assignees: LG ELECTRONICS INC., Seoul (KR); INDUSTRY-UNIVERSITY COOPERATION FOUNDATION HANYANG UNIVERSITY, Seoul (KR)

( * ) Notice: Subject to any disclaimer, the term of this patent is extended or adjusted under 35 U.S.C. 154(b) by 0 days.

(21) Appl. No.: 17/258,069

(22) PCT Filed: Oct. 18, 2018

(86) PCT No.: PCT/KR2018/012317

§ 371 (c)(1),
(2) Date: Jan. 5, 2021

(87) PCT Pub. No.: WO2020/009279

PCT Pub. Date: Jan. 9, 2020

(65) Prior Publication Data

US 2021/0166620 A1 Jun. 3, 2021

(30) Foreign Application Priority Data

Jul. 6, 2018 (KR) ..... 10-2018-0078922

(51) Int. Cl.
*G09G 3/32* (2016.01)

(52) U.S. Cl.
CPC ..... *G09G 3/32* (2013.01); *G09G 2310/027* (2013.01); *G09G 2310/0272* (2013.01); *G09G 2330/028* (2013.01)

(58) Field of Classification Search
CPC ..... G09G 3/32; G09G 2310/027; G09G 2310/0272; G09G 2330/028
See application file for complete search history.

(56) References Cited

U.S. PATENT DOCUMENTS 10,847,083 B1 * 11/2020 Pan ..... H01L 27/15
2006/0238943 A1 * 10/2006 Awakura ..... G09G 3/3258 361/93.1

(Continued)

FOREIGN PATENT DOCUMENTS

KR 10-2008-0075843 A 8/2008
KR 10-2015-0049682 A 5/2015
KR 10-2018-0009116 A 1/2018

*Primary Examiner* — Andrew Sasinowski
(74) *Attorney, Agent, or Firm* — Birch, Stewart, Kolasch & Birch, LLP

(57) ABSTRACT

Discussed is a display device including a plurality of semiconductor light-emitting devices applied to sub-pixels included in each pixel of a display panel; and a driving unit for driving the plurality of semiconductor light-emitting devices on the basis of a digital pulse width modulation (PWM) signal, wherein the driving unit further includes: a current sensing unit for sensing the value of a current flowing through at least one of the plurality of semiconductor light-emitting devices; and a current compensation unit for compensating for the current deviation between the plurality of semiconductor light-emitting devices on the basis of the current value sensed by the sensing unit.

20 Claims, 20 Drawing Sheets

(56) References Cited

U.S. PATENT DOCUMENTS

| | | | | |
|---|---|---|---|---|
| 2018/0075798 | A1* | 3/2018 | Nho | G09G 3/32 |
| 2018/0182279 | A1 | 6/2018 | Sakariya et al. | |
| 2018/0197453 | A1* | 7/2018 | Lee | G09G 3/2077 |
| 2018/0301080 | A1* | 10/2018 | Shigeta | G09G 3/3208 |

* cited by examiner

DISPLAY DEVICE AND DRIVING METHOD THEREFOR

CROSS REFERENCE TO RELATED APPLICATIONS

This application is the National Stage filing under 35 U.S.C. 371 of International Application No. PCT/KR2018/012317, filed on Oct. 18, 2018, which claims the benefit of earlier filing date and right of priority to Korean Application No. 10-2018-0078922, filed on Jul. 6, 2018, the contents of all these applications are all hereby incorporated by reference herein in their entirety.

BACKGROUND

1. Technical Field

The present disclosure relates to a display device and a driving method thereof.

2. Description of the Related Art

In recent years, display devices having excellent characteristics such as low profile, flexibility and the like have been developed in the display technical field. On the contrary, currently commercialized main displays are represented by liquid crystal displays (LCDs) and active matrix organic light-emitting diodes (AMOLEDs). However, there exist problems such as not-so-fast response time, difficult implementation of flexibility in case of LCDs, and there exist drawbacks such as short life span, not-so-good yield as well as weakness in flexibility in case of AMOLEDs.

On the other hand, light-emitting diodes (LEDs) are well known light-emitting devices for converting an electrical current to light, and have been used as a light source for displaying an image in an electronic device including information communication devices since red LEDs using GaAsP compound semiconductors were made commercially available in 1962, together with a GaP:N-based green LEDs. Accordingly, the semiconductor light-emitting devices may be used to implement a flexible display, thereby presenting a scheme for solving the problems.

Furthermore, in such a display device, the development of thin-film display technology has become an important part as slimming is accelerated. In addition, the development of a touch screen that can be controlled using a finger or a pen on the display screen is also an important part in the modern industry. Meanwhile, a general touch screen driving is divided into a display driving time and a touch driving time to be driven, however, during the display driving time, a touch circuit is not driven because display panel noise is induced into a touch sensor and there is a high probability of failure during touch recognition. Moreover, during the touch driving time, the display is not driven for touch recognition. However, in the case of such time division, since the display does not emit light during the touch driving time, light emission time in the unit frame decreases to decrease the maximum display luminance.

Besides, a display device according to the related art requires a saw tooth wave signal by driving a digital panel based on an analog type pulse width modulation (PWM), and an analog comparator must be included in a micro integrated circuit that drives pixels, thereby increasing a size of the micro integrated circuit.

A display device according to the related art requires a digital-to-analog converter (DAC) that converts digital data into analog data for a data driving unit since a digital panel is driven based on an analog type pulse width modulation (PWM).

SUMMARY

An aspect of the present disclosure is to provide a display device that compensates for a current deviation between a plurality of semiconductor light-emitting diodes (LEDs) applied to sub-pixels in a display panel driven by a digital pulse width modulation (PWM) mode, and a driving method thereof.

Another aspect of the present disclosure is to provide a display device that compensates for a current deviation between a current flowing through a semiconductor light-emitting device applied to a sub-pixel in a display panel driven by a digital PWM method and a reference current, and a driving method thereof.

The objectives of the present disclosure are not limited to the objectives mentioned above, and other objectives that are not mentioned herein will be clearly understood by those skilled in the art from the following description.

In order to achieve the objectives, a display device according to embodiments of the present disclosure may include a plurality of semiconductor light-emitting devices applied to sub-pixels included in a pixel of a display panel, and a driving unit that drives the plurality of semiconductor light-emitting devices based on a digital pulse width modulation (PWM) signal, wherein the driving unit further includes a current sensing unit that senses a value of a current flowing through at least one of the plurality of semiconductor light-emitting devices, and a current compensation unit that compensates for a current deviation between the plurality of semiconductor-light-emitting devices based on the value of the current sensed by the current sensing unit.

According to an embodiment, the driving unit may include a switching unit connected to each of the plurality of semiconductor light-emitting devices to switch the plurality of semiconductor light-emitting devices according to the digital PWM signal, and the current compensation unit may include a compensation unit connected between the switching unit and the ground to compensate for a current deviation between the plurality of semiconductor light-emitting devices.

According to an embodiment, the present disclosure may further include an operational amplifier that applies a difference between a voltage applied to the plurality of semiconductor light-emitting devices and a set voltage to the driving unit, wherein the current compensation unit further includes a variable reference generator that changes the set voltage according to the value of the current sensed by the current sensing unit.

According to an embodiment, the current sensing unit may be connected to the sub-pixels and the variable reference generator to transmit a current equal to a current flowing through at least one of the semiconductor light-emitting devices applied to the sub-pixels to the variable reference generator.

According to an embodiment, the variable reference generator may change the set voltage according to a deviation between a current flowing through at least one of the semiconductor light-emitting devices applied to the sub-pixels and a reference current.

According to an embodiment, the variable reference generator may increase the set voltage when a current flowing through at least one of the semiconductor light-emitting devices applied to the sub-pixels is less than a reference current, and decrease the set voltage when the current flowing through at least one of the semiconductor light-emitting devices applied to the sub-pixels is greater than the reference current.

According to an embodiment, the compensation unit may include a first resistor connected in series to a first switching unit that switches a first semiconductor light-emitting device among the plurality of semiconductor light-emitting devices, a second resistor electrically connected between a point between the first switching unit and the first resistor and an input terminal of the operational amplifier, a third resistor connected in series to a second switching unit that switches a second semiconductor light-emitting device among the plurality of semiconductor light-emitting devices, and a fourth resistor electrically connected between a point between the second switching unit and the third resistor and an input terminal of the operational amplifier.

According to an embodiment, the driving unit may include a PWM generation unit that generates the digital PWM signal.

According to an embodiment, the current compensation unit may compensate for the current deviation while at the same time determining a value of a current flowing through the plurality of semiconductor light-emitting devices.

According to an embodiment, the driving unit may be a single micro-integrated circuit, and the single micro-integrated circuit may drive a plurality of pixels, and each of the plurality of pixels may include a plurality of sub-pixels.

A drive device of an LED display according to embodiments of the present disclosure may compensate for a current deviation between a plurality of semiconductor light-emitting devices applied to sub-pixels in a display panel, thereby improving the image quality of the display.

A drive device of an LED display according to embodiments of the present disclosure may compensate for a current deviation between a current flowing through a semiconductor light-emitting device applied to a sub-pixel in a display panel and a reference current, thereby further improving the image quality of the display.

A drive device of an LED display according to embodiments of the present disclosure may drive a digital panel in a digital PWM mode, and use serial digital data as it is, thereby eliminating the need for driving TFT (thin film transistor) compensation required in a semiconductor (oxide and LTPS (low temperature poly silicon, etc.) substrate backplane process, and reducing a power supply voltage (ELVDD) for driving pixels.

A drive device of an LED display according to embodiments of the present disclosure may drive a digital panel in a digital PWM mode, and use serial digital data as it is, thereby allowing input data at a low voltage. For example, a silicon-based transistor having high mobility may be used, thereby reducing power consumption when applying data.

A drive device of an LED display according to embodiments of the present disclosure may eliminate the need for a digital-to-analog converter (DAC) for converting digital data into analog data in a data driving unit. For example, a drive device of an LED display according to embodiments of the present disclosure may apply data in a digital mode, and thus a digital-to-analog converter (DAC) is not required in a data driving unit.

A drive device of the LED display according to embodiments of the present disclosure may eliminate the need for a digital-to-analog converter (DAC) in a data driving unit, thereby reducing a size of the data driving unit.

A drive device of an LED display according to the embodiments of the present disclosure may secure a wide current range, and be applicable to a tiling display.

The effects of the present disclosure are not limited to the effects mentioned above, and other effects that are not mentioned herein will be clearly understood by those skilled in the art from the description of claims.

DETAILED DESCRIPTION OF THE EMBODIMENTS

Figure 1:
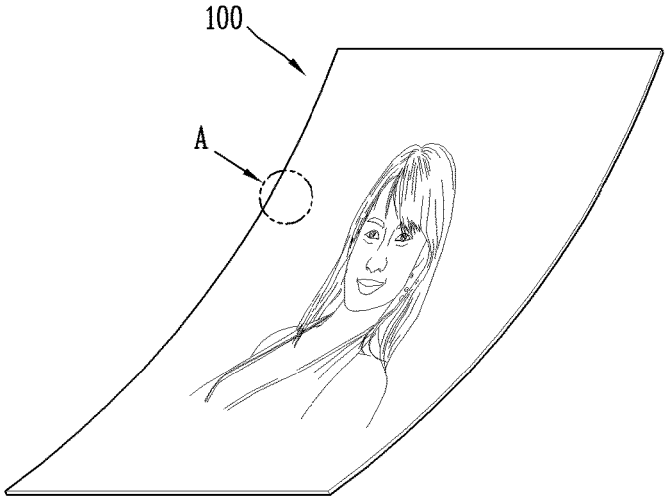
FIG. 1 is a conceptual view showing a display device using a semiconductor light-emitting device according to an embodiment of the present disclosure.

Hereinafter, the embodiments disclosed herein will be described in detail with reference to the accompanying drawings, and the same or similar elements are designated with the same numeral references regardless of the numerals in the drawings and their redundant description will be omitted. A suffix "module" and "unit" used for constituent elements disclosed in the following description is merely intended for easy description of the specification, and the suffix itself does not give any special meaning or function. In describing an embodiment disclosed herein, moreover, the detailed description will be omitted when specific description for publicly known technologies to which the invention pertains is judged to obscure the gist of the present disclosure. Also, it should be noted that the accompanying drawings are merely illustrated to easily explain the concept of the invention, and therefore, they should not be construed to limit the technological concept disclosed herein by the accompanying drawings.

Furthermore, it will be understood that when an element such as a layer, region or substrate is referred to as being "on" another element, it can be directly on the another element or an intermediate element may also be interposed therebetween.

A display device disclosed herein may include a portable phone, a smart phone, a laptop computer, a digital broadcast terminal, a personal digital assistant (PDA), a portable multimedia player (PMP), a navigation, a slate PC, a tablet PC, an ultrabook, a digital TV, a desktop computer, and the like. However, it would be easily understood by those skilled in the art that a configuration disclosed herein may be applicable to any displayable device even though it is a new product type which will be developed later.

FIG. 1 is a conceptual view showing a display device using a semiconductor light-emitting device according to an embodiment of the present disclosure.

According to the drawing, information processed in the controller of the display device 100 may be displayed using a flexible display.

The flexible display may include a flexible, bendable, twistable, foldable and rollable display. For example, the flexible display may be a display manufactured on a thin and flexible substrate that can be warped, bent, folded or rolled like a paper sheet while maintaining the display characteristics of a flat display in the related art.

A display area of the flexible display becomes a plane in a configuration that the flexible display is not warped (for example, a configuration having an infinite radius of curvature, hereinafter, referred to as a "first configuration"). The display area thereof becomes a curved surface in a configuration that the flexible display is warped by an external force in the first configuration (for example, a configuration having a finite radius of curvature, hereinafter, referred to as a "second configuration"). As illustrated, information displayed in the second configuration may be visual information displayed on a curved surface. The visual information may be implemented by individually controlling the light emission of sub-pixels disposed in a matrix form. The sub-pixel refers to a minimum unit for implementing a single color formed by a combination of R (Red), G (Green), and B (Blue).

The sub-pixel of the flexible display may be implemented by a semiconductor light-emitting device. According to the present disclosure, a light-emitting diode (LED) is illustrated as a type of semiconductor light-emitting device. The light-emitting diode may be formed with a small size to perform the role of a sub-pixel even in the second configuration through this.

Hereinafter, a flexible display implemented using the light-emitting diode will be described in more detail with reference to the accompanying drawings.

Figure 2:
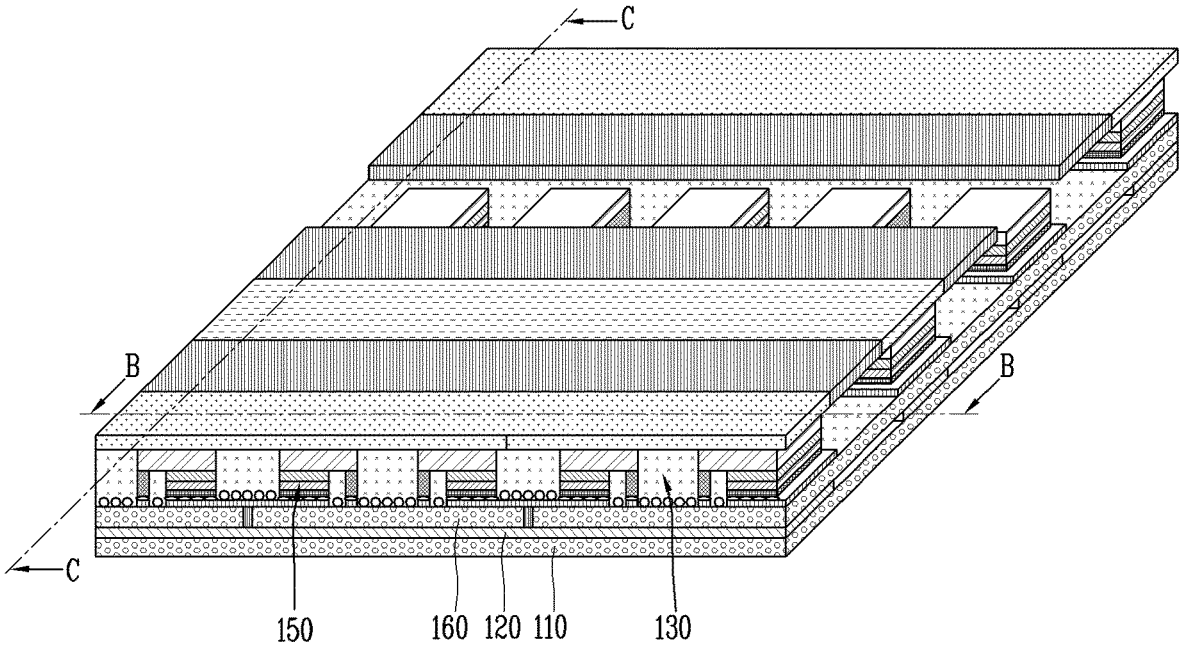
FIG. 2 is a partial enlarged view of portion "A" in FIG. 1, and FIGS. 3A and 3B are cross-sectional views taken along lines B-B and C-C in FIG. 2.
Figure 3A:
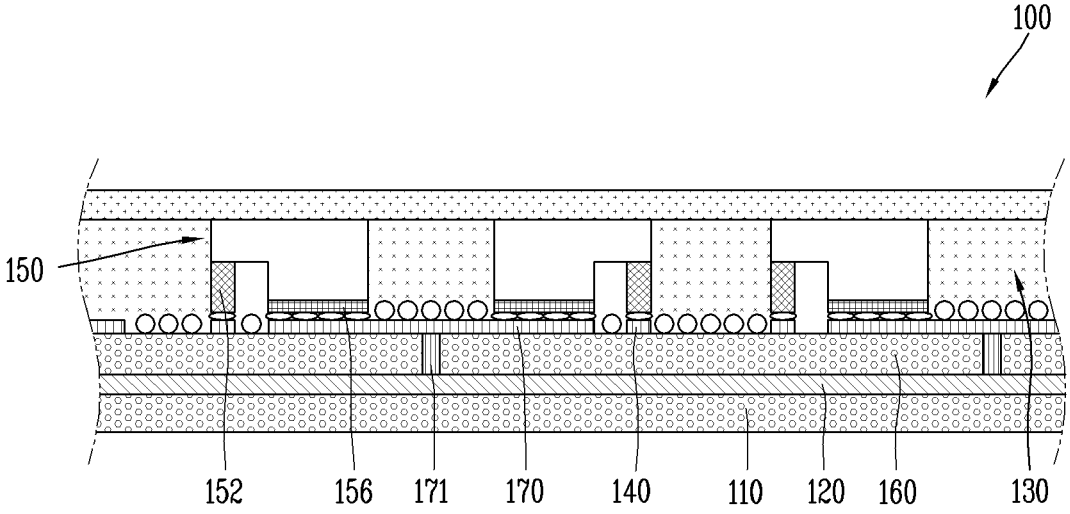
Figure 3B:
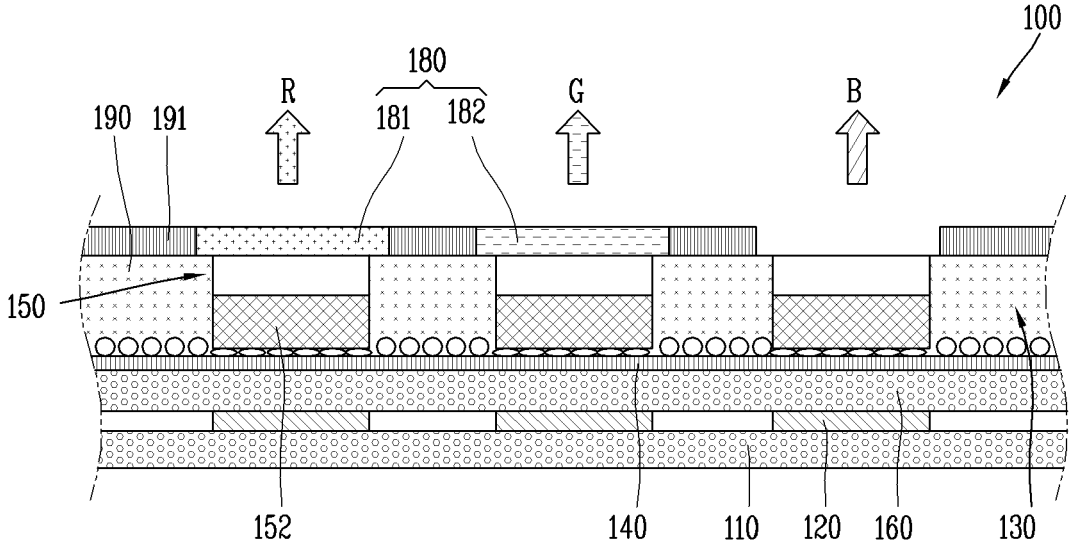
Figure 4:
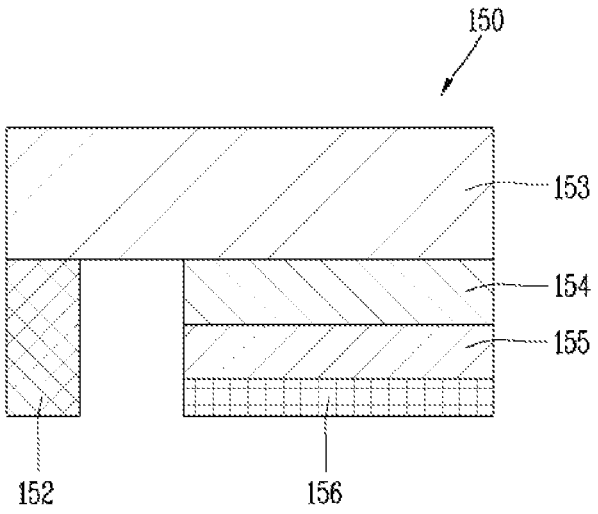
FIG. 4 is a conceptual view showing a flip-chip type semiconductor light-emitting device in FIG. 3A.

FIG. 2 is a partial enlarged view of portion "A" in FIG. 1, and FIGS. 3A and 3B are cross-sectional views taken along line in FIG. 2, FIG. 4 is a conceptual view illustrating a flip-chip type semiconductor light-emitting device in FIG. 3, and FIGS. 5A through 5C are conceptual views illustrating various forms for implementing colors in connection with a flip-chip type semiconductor light-emitting device.

According to the drawings in FIGS. 2, 3A and 3B, there is illustrated a display device 100 using a passive matrix (PM) type semiconductor light-emitting device as a display device 100 using a semiconductor light-emitting device. However, an example described below may also be applicable to an active matrix (AM) type semiconductor light-emitting device.

The display device 100 may include a substrate 110, a first electrode 120, a conductive adhesive layer 130, a second electrode 140, and a plurality of semiconductor light-emitting devices 150.

The substrate 110 may be a flexible substrate. The substrate 110 may contain glass or polyimide (PI) to implement the flexible display device. In addition, if it is an insulating and flexible material, any one such as polyethylene naphthalate (PEN), polyethylene terephthalate (PET) or the like may be used. Furthermore, the substrate 110 may be either one of transparent and non-transparent materials.

The substrate 110 may be a wiring substrate disposed with the first electrode 120, and thus the first electrode 120 may be placed on the substrate 110.

According to the drawing, an insulating layer 160 may be disposed on the substrate 110 placed with the first electrode 120, and an auxiliary electrode 170 may be placed on the insulating layer 160. In this case, a configuration in which the insulating layer 160 is deposited on the substrate 110 may be a single wiring substrate. More specifically, the insulating layer 160 may be incorporated into the substrate 110 with an insulating and flexible material such as polyimide (PI), PET, PEN or the like to form a single wiring substrate.

The auxiliary electrode 170 as an electrode for electrically connecting the first electrode 120 to the semiconductor light-emitting device 150 is placed on the insulating layer 160, and disposed to correspond to the location of the first electrode 120. For example, the auxiliary electrode 170 has a dot shape, and may be electrically connected to the first electrode 120 by means of an electrode hole 171 passing through the insulating layer 160. The electrode hole 171 may be formed by filling a conductive material in a via hole.

Referring to the drawings, the conductive adhesive layer 130 may be formed on one surface of the insulating layer 160, but the present disclosure may not be necessarily limited to this. For example, it may be possible to also have a structure in which the conductive adhesive layer 130 is disposed on the substrate 110 with no insulating layer 160. The conductive adhesive layer 130 may perform the role of an insulating layer in the structure in which the conductive adhesive layer 130 is disposed on the substrate 110.

The conductive adhesive layer 130 may be a layer having adhesiveness and conductivity, and to this end, a conductive material and an adhesive material may be mixed on the conductive adhesive layer 130. Furthermore, the conductive adhesive layer 130 may have flexibility, thereby allowing a flexible function in the display device.

For such an example, the conductive adhesive layer 130 may be an anisotropic conductive film (ACF), an anisotropic conductive paste, a solution containing conductive particles, and the like. The conductive adhesive layer 130 may allow electrical interconnection in the z-direction passing through the thickness thereof, but may be configured as a layer having electrical insulation in the horizontal x-y direction thereof. Accordingly, the conductive adhesive layer 130 may be referred to as a z-axis conductive layer (however, hereinafter referred to as a "conductive adhesive layer").

The anisotropic conductive film is a film with a form in which an anisotropic conductive medium is mixed with an insulating base member, and thus when heat and pressure are applied thereto, only a specific portion thereof may have conductivity by means of the anisotropic conductive medium. Hereinafter, heat and pressure are applied to the anisotropic conductive film, but other methods may be also available for the anisotropic conductive film to partially have conductivity. The methods may include applying only either one of heat and pressure thereto, UV curing, and the like.

Furthermore, the anisotropic conductive medium may be conductive balls or particles. According to the drawing, in the present example, the anisotropic conductive film is a film with a form in which an anisotropic conductive medium is mixed with an insulating base member, and thus when heat and pressure are applied thereto, only a specific portion thereof may have conductivity by means of the conductive balls. The anisotropic conductive film may be in a state in which a core with a conductive material contains a plurality of particles coated by an insulating layer with a polymer material, and in this case, it may have conductivity by means of the core while breaking an insulating layer on a portion to which heat and pressure are applied. Here, a core may be transformed to implement a layer having both surfaces to which objects contact in the thickness direction of the film. For a more specific example, heat and pressure are applied to an anisotropic conductive film as a whole, and electrical connection in the z-axis direction is partially formed by a height difference from a mating object adhered by the use of the anisotropic conductive film.

For another example, an anisotropic conductive film may be in a state containing a plurality of particles in which a conductive material is coated on insulating cores. In this case, a portion to which heat and pressure are applied may be converted (pressed and adhered) to a conductive material to have conductivity in the thickness direction of the film. For still another example, it may be formed to have conductivity in the thickness direction of the film in which a conductive material passes through an insulating base member in the z-direction. In this case, the conductive material may have a pointed end portion.

According to the drawing, the anisotropic conductive film may be a fixed array anisotropic conductive film (ACF) configured with a form in which conductive balls are inserted into one surface of the insulating base member. More specifically, the insulating base member is formed of an adhesive material, and the conductive balls are intensively disposed at a bottom portion of the insulating base member, and when heat and pressure are applied thereto, the base member is modified along with the conductive balls, thereby having conductivity in the vertical direction thereof.

However, the present disclosure may not be necessarily limited to this, and the anisotropic conductive film may be all allowed to have a form in which conductive balls are randomly mixed with an insulating base member or a form configured with a plurality of layers in which conductive balls are disposed at any one layer (double-ACF), and the like.

The anisotropic conductive paste as a form coupled to a paste and conductive balls may be a paste in which conductive balls are mixed with an insulating and adhesive base material. Furthermore, a solution containing conductive particles may be a solution in a form containing conductive particles or nano particles.

Referring again to the drawing, the second electrode 140 is located at the insulating layer 160 to be separated from the auxiliary electrode 170. In other words, the conductive adhesive layer 130 is disposed on the insulating layer 160 located with the auxiliary electrode 170 and second electrode 140.

When the conductive adhesive layer 130 is formed in a state that the auxiliary electrode 170 and second electrode 140 are located, and then the semiconductor light-emitting device 150 is connect thereto in a flip chip form with the application of heat and pressure, the semiconductor light-emitting device 150 is electrically connected to the first electrode 120 and second electrode 140.

Referring to FIG. 4, the semiconductor light-emitting device may be a flip chip type semiconductor light-emitting device.

For example, the semiconductor light-emitting device may include a p-type electrode 156, a p-type semiconductor layer 155 formed with the p-type electrode 156, an active layer 154 formed on the p-type semiconductor layer 155, an n-type semiconductor layer 153 formed on the active layer 154, and an n-type electrode 152 disposed to be separated from the p-type electrode 156 in the horizontal direction on the n-type semiconductor layer 153. In this case, the p-type electrode 156 may be electrically connected to the welding portion 179 by the conductive adhesive layer 130, and the n-type electrode 152 may be electrically connected to the second electrode 140.

Referring to FIGS. 2, 3A and 3B again, the auxiliary electrode 170 may be formed in an elongated manner in one direction to be electrically connected to a plurality of semiconductor light-emitting devices 150. For example, the left and right p-type electrodes of the semiconductor light-emitting devices around the auxiliary electrode may be electrically connected to one auxiliary electrode.

More specifically, the semiconductor light-emitting device 150 is pressed into the conductive adhesive layer 130, and through this, only a portion between the p-type electrode 156 and auxiliary electrode 170 of the semiconductor light-emitting device 150 and a portion between the n-type electrode 152 and second electrode 140 of the semiconductor light-emitting device 150 have conductivity, and the remaining portion does not have conductivity since there is no push-down of the semiconductor light-emitting device. As described above, the conductive adhesive layer 130 may form an electrical connection as well as allow a mutual coupling between the semiconductor light-emitting device 150 and the auxiliary electrode 170 and between the semiconductor light-emitting device 150 and the second electrode 140.

Furthermore, a plurality of semiconductor light-emitting devices 150 constitute a light-emitting array, and a phosphor layer 180 is formed on the light-emitting array.

The light-emitting device array may include a plurality of semiconductor light-emitting devices with different self-luminance values. Each of the semiconductor light-emitting devices 150 is combined (or grouped) to constitute a sub-pixel, and is electrically connected to the first electrode 120. For example, there may exist a plurality of first electrodes 120, and the semiconductor light-emitting devices are arranged in several rows, for instance, and each row of the semiconductor light-emitting devices may be electrically connected to any one of the plurality of first electrodes.

Furthermore, the semiconductor light-emitting devices may be connected in a flip chip form, and thus semiconductor light-emitting devices grown on a transparent dielectric substrate. Furthermore, the semiconductor light-emitting devices may be nitride semiconductor light-emitting devices, for instance. The semiconductor light-emitting device 150 may have excellent luminance characteristics, and thus it may be possible to configure individual unit pixels even with a small size thereof.

According to the drawing, a partition wall 190 may be formed between the semiconductor light-emitting devices 150. In this case, the partition wall 190 may serve to separate the semiconductor light-emitting devices from each other, and may be integrally formed with the conductive adhesive layer 130. For example, a base member of the anisotropic conductive film may form the partition wall when the semiconductor light-emitting device 150 is inserted into the anisotropic conductive film.

Furthermore, when the base member of the anisotropic conductive film is black, the partition wall 190 may have reflective characteristics while at the same time increasing contrast with no additional black insulator.

For another example, a reflective partition wall may be separately provided with the partition wall 190. In this case, the partition wall 190 may include a black or white insulator according to the purpose of the display device. When a partition wall of a white insulator is used, an effect of enhancing reflectivity may be obtained. When a partition wall of a black insulator is used, a contrast ratio may be increased while having a reflection characteristic.

The phosphor layer 180 may be located at an outer surface of the semiconductor light-emitting device 150. For example, the semiconductor light-emitting device 150 is a blue semiconductor light-emitting device that emits blue (B) light, and the phosphor layer 180 performs a function of converting the blue (B) light into the color of a sub-pixel. The phosphor layer 180 may be a red phosphor layer 181 or green phosphor layer 182 constituting individual pixels.

In other words, a red phosphor 181 capable of converting blue light into red (R) light may be deposited on the blue semiconductor light-emitting device 151 at a position implementing a red sub-pixel, and a green phosphor 182 capable of converting blue light into green (G) light may be deposited on the blue semiconductor light-emitting device 151 at a position implementing a green sub-pixel. Furthermore, only the blue semiconductor light-emitting device 151 may be solely used at a location implementing a blue sub-pixel. In this case, the red (R), green (G) and blue (B) sub-pixels may implement one pixel. More specifically, one color phosphor may be deposited along each line of the first electrode 120. Accordingly, one line on the first electrode 120 may be an electrode controlling one color. In other words, red (R), green (B) and blue (B) may be sequentially disposed along the second electrode 140, thereby implementing sub-pixels.

However, the present disclosure may not be necessarily limited to this, and the semiconductor light-emitting device 150 may be combined with a quantum dot (QD) instead of a phosphor to implement sub-pixels that emit red (R), green (G) and blue (B).

Furthermore, a black matrix 191 may be disposed between each phosphor layer to enhance contrast. In other words, the black matrix 191 can enhance the contrast of luminance.

However, the present disclosure may not be necessarily limited to this, and another structure for implementing blue, red and green may be also applicable thereto.

Figure 5A:
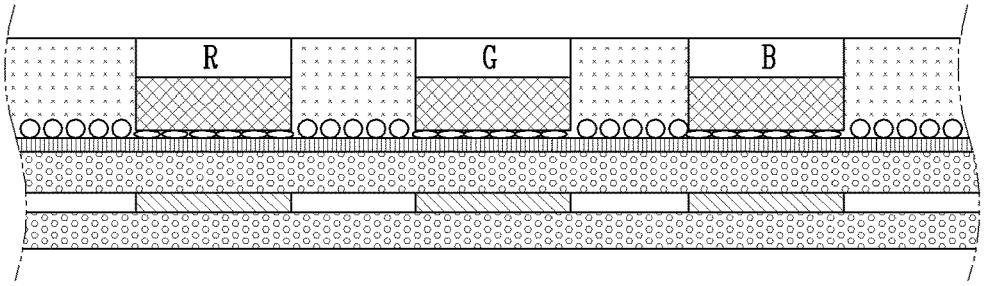
FIGS. 5A through 5C are conceptual views showing various forms for implementing colors in connection with a flip-chip type semiconductor light-emitting device.

Referring to FIG. 5A, each of the semiconductor light-emitting devices 150 may be implemented with a high-power light-emitting device that emits various lights including blue in which gallium nitride (GaN) is mostly used, and indium (In) and or aluminum (Al) are added thereto.

In this case, the semiconductor light-emitting device 150 may be red, green and blue semiconductor light-emitting devices, respectively, to implement each sub-pixel. For instance, red, green and blue semiconductor light-emitting devices (R, G, B) are alternately disposed, and red, green and blue sub-pixels implement one pixel by means of the red, green and blue semiconductor light-emitting devices, thereby implementing a full color display.

Figure 5B:
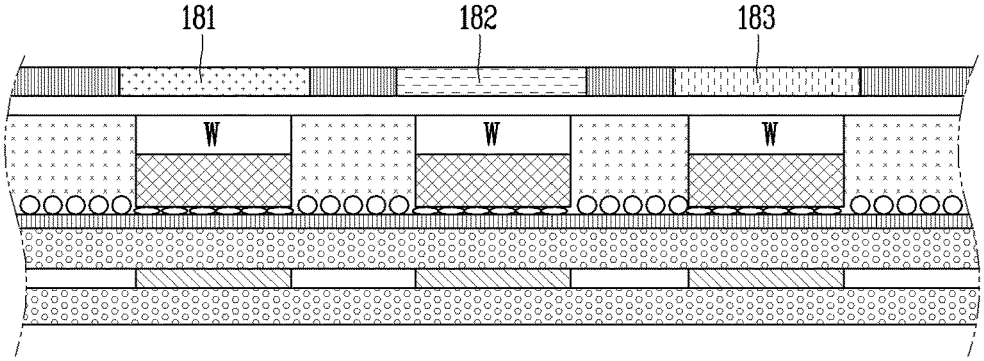

Referring to FIG. 5B, the semiconductor light-emitting device may have a white light-emitting device (W) provided with a yellow phosphor layer for each element. In this case, a red phosphor layer 181, a green phosphor layer 182 and blue phosphor layer 183 may be provided on the white light-emitting device (W) to implement a sub-pixel. Furthermore, a color filter repeated with red, green and blue on the white light-emitting device (VV) may be used to implement a sub-pixel.

Figure 5C:
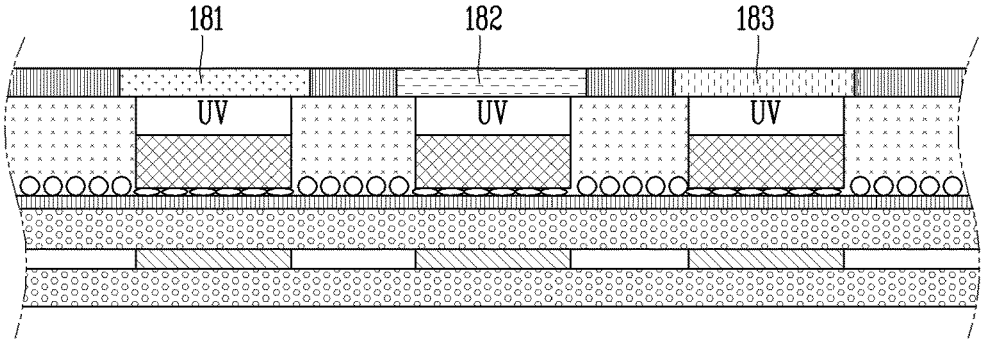

Referring to FIG. 5C, it may be possible to also have a structure in which a red phosphor layer 181, a green phosphor layer 182 and blue phosphor layer 183 may be provided on a ultra violet light-emitting device (UV). In this manner, the semiconductor light-emitting device can be used over the entire region up to ultra violet (UV) as well as visible light, and may be extended to a form of semiconductor light-emitting device in which ultra violet (UV) can be used as an excitation source.

Taking the present example into consideration again, the semiconductor light-emitting device 150 is placed on the conductive adhesive layer 130 to constitute a sub-pixel in the display device. The semiconductor light-emitting device 150 may have excellent luminance characteristics, and thus it may be possible to configure individual sub-pixels even with a small size thereof. The size of the individual semiconductor light-emitting device 150 may be less than 80 μm in the length of one side thereof, and formed with a rectangular or square shaped element. In case of a rectangular shaped element, the size thereof may be less than 20×80 μm.

Furthermore, even when a square shaped semiconductor light-emitting device 150 with a length of side of 10 μm is used for a sub-pixel, it will exhibit a sufficient brightness for implementing a display device. Accordingly, for example, in case of a rectangular pixel in which one side of a sub-pixel is 600 μm in size, and the remaining one side thereof is 300 μm, a relative distance between the semiconductor light-emitting devices becomes sufficiently large. Accordingly, in this case, it may be possible to implement a flexible display device having a HD image quality.

A display device using the foregoing semiconductor light-emitting device will be manufactured by a new type of manufacturing method. Hereinafter, the manufacturing method will be described with reference to FIG. 6.

Figure 6:
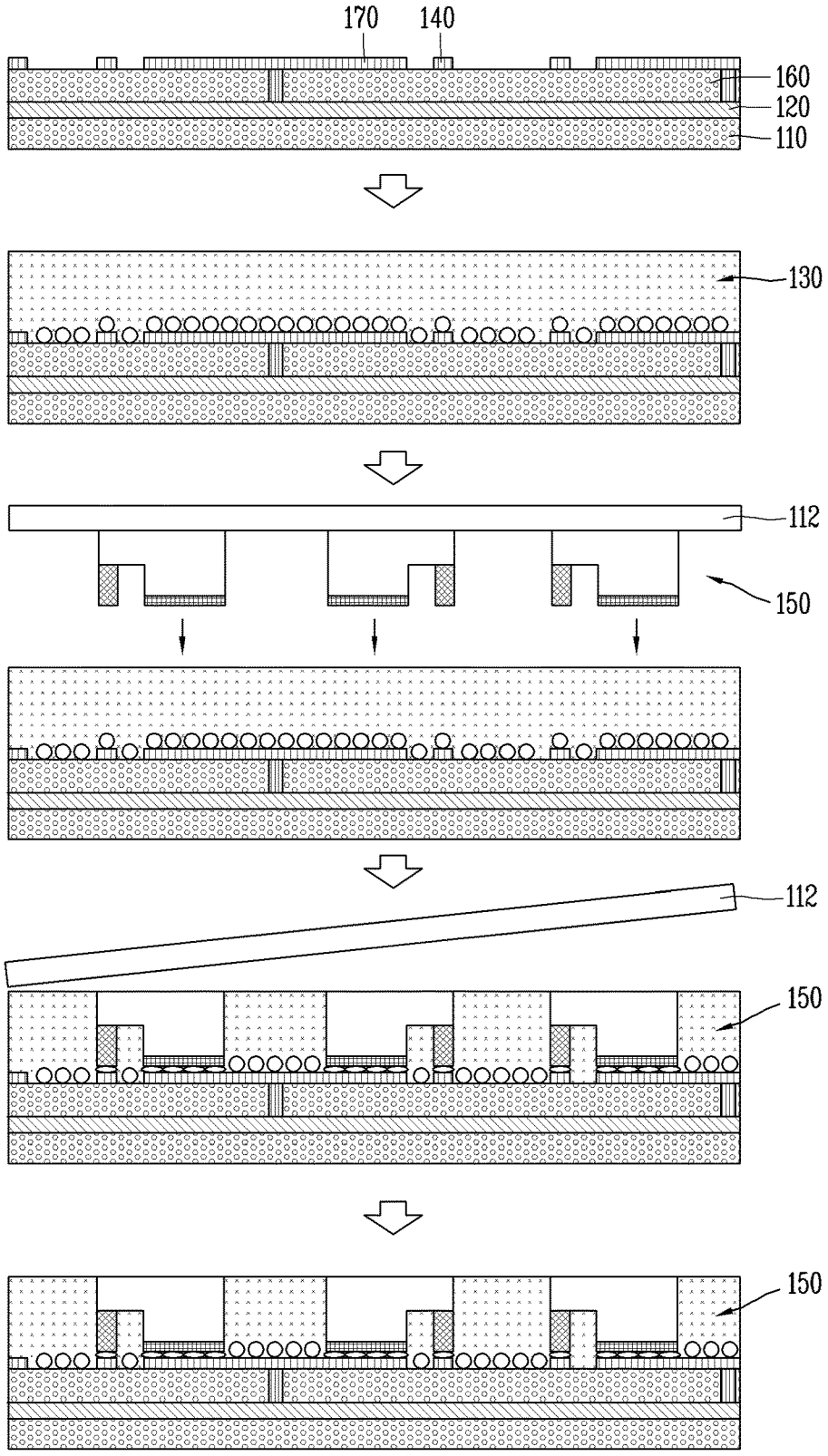
FIG. 6 is cross-sectional views showing a manufacturing method of a display device using a semiconductor light-emitting device according to the present disclosure.

FIG. 6 is cross-sectional views illustrating a manufacturing method of a display device using a semiconductor light-emitting device according to the present disclosure.

Referring to the drawing, first, the conductive adhesive layer 130 is formed on the insulating layer 160 located with the auxiliary electrode 170 and second electrode 140. The insulating layer 160 is deposited on the first substrate 110 to form one substrate (or wiring substrate), and the first electrode 120, auxiliary electrode 170 and second electrode 140 are disposed at the wiring substrate. In this case, the first electrode 120 and second electrode 140 may be disposed in a perpendicular direction to each other. Furthermore, the first substrate 110 and insulating layer 160 may contain glass or polyimide (PI), respectively, to implement a flexible display device.

The conductive adhesive layer 130 may be implemented by an anisotropic conductive film, for example, and to this end, an anisotropic conductive film may be coated on a substrate located with the insulating layer 160.

Next, a second substrate 112 located with a plurality of semiconductor light-emitting devices 150 corresponding to the location of the auxiliary electrodes 170 and second electrodes 140 and constituting individual pixels is disposed such that the semiconductor light-emitting device 150 faces the auxiliary electrode 170 and second electrode 140.

In this case, the second substrate 112 as a growth substrate for growing the semiconductor light-emitting device 150 may be a sapphire substrate or silicon substrate.

The semiconductor light-emitting device may have a gap and size capable of implementing a display device when formed in the unit of wafer, and thus effectively used for a display device.

Next, the wiring substrate is thermally compressed to the second substrate 112. For example, the wiring substrate and second substrate 112 may be thermally compressed to each other by applying an ACF press head. The wiring substrate and second substrate 112 are bonded to each other using the thermal compression. Only a portion between the semiconductor light-emitting device 150 and the auxiliary electrode 170 and second electrode 140 may have conductivity due to the characteristics of an anisotropic conductive film having conductivity by thermal compression, thereby allowing the electrodes and semiconductor light-emitting device 150 to be electrically connected to each other. At this time, the semiconductor light-emitting device 150 may be inserted into the anisotropic conductive film, thereby forming a partition wall between the semiconductor light-emitting devices 150.

Next, the second substrate 112 is removed. For example, the second substrate 112 may be removed using a laser lift-off (LLO) or chemical lift-off (CLO) method.

Finally, the second substrate 112 is removed to expose the semiconductor light-emitting devices 150 to the outside. Silicon oxide (SiOx) or the like may be coated on the wiring substrate coupled to the semiconductor light-emitting device 150 to form a transparent insulating layer (not shown).

Furthermore, it may further include the process of forming a phosphor layer on one surface of the semiconductor light-emitting device 150. For example, the semiconductor light-emitting device 150 may be a blue semiconductor light-emitting device for emitting blue (B) light, and red or green phosphor for converting the blue (B) light into the color of the sub-pixel may form a layer on one surface of the blue semiconductor light-emitting device.

The manufacturing method or structure of a display device using the foregoing semiconductor light-emitting device may be modified in various forms. For such an example, the foregoing display device may be applicable to a vertical semiconductor light-emitting device. Hereinafter, the vertical structure will be described with reference to FIGS. 5 and 6.

Furthermore, according to the following modified example or embodiment, the same or similar reference numerals are designated to the same or similar configurations to the foregoing example, and the description thereof will be substituted by the earlier description.

Figure 7:
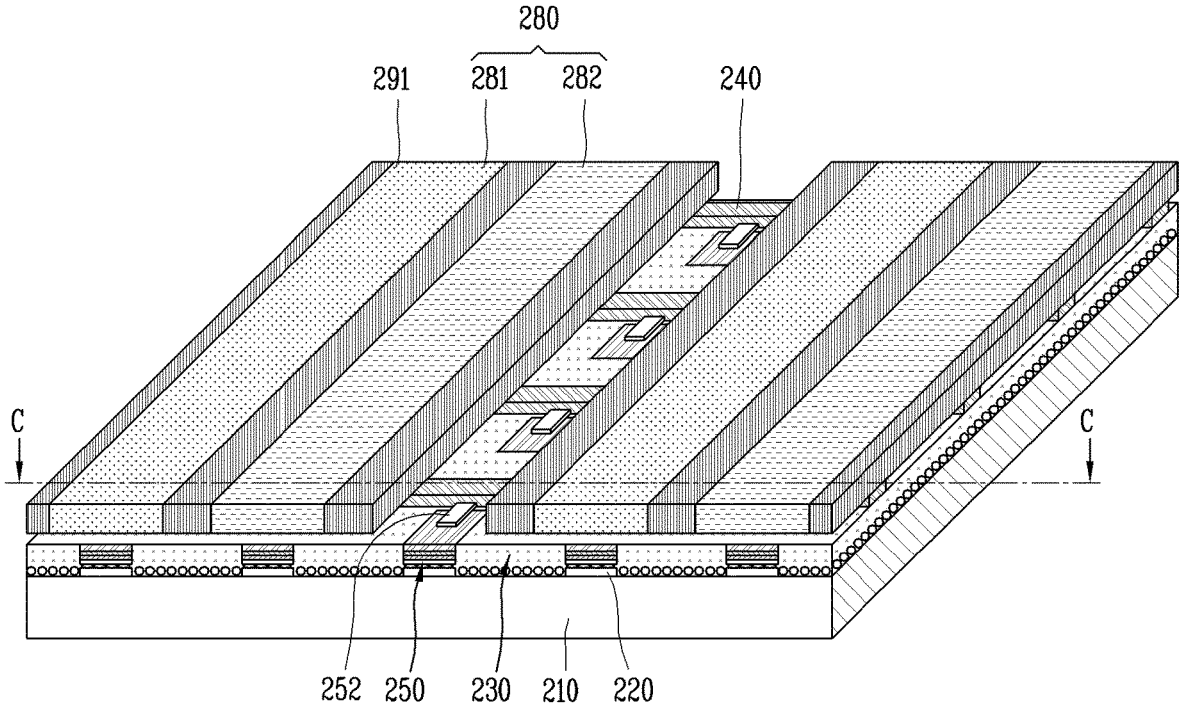
FIG. 7 is a perspective view showing a display device using a semiconductor light-emitting device according to another embodiment of the present disclosure.
Figure 8:
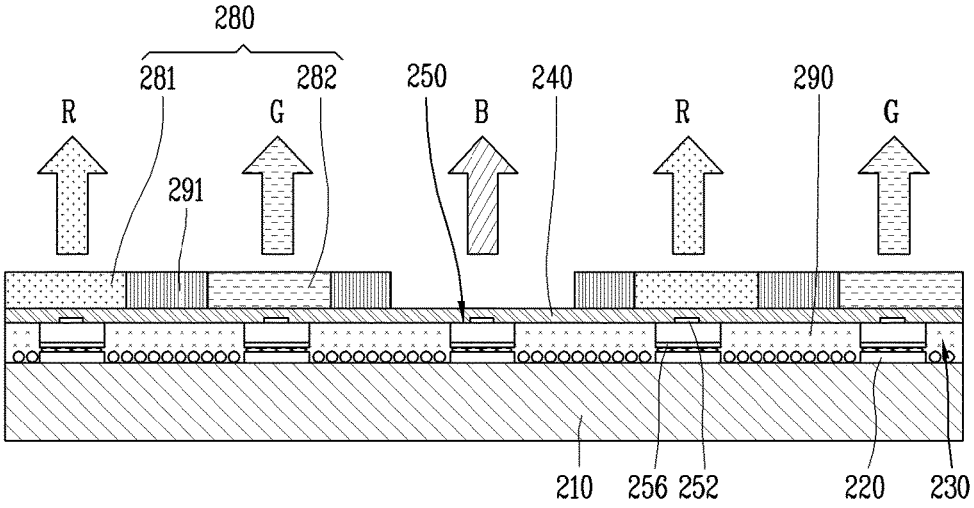
FIG. 8 is a cross-sectional view taken along line C-C in FIG. 7.
Figure 9:
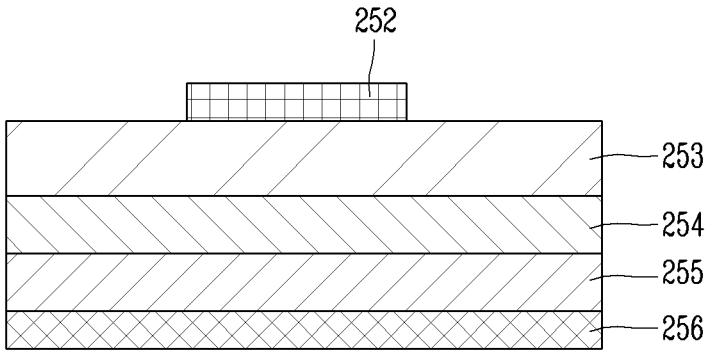
FIG. 9 is a conceptual view showing a vertical semiconductor light-emitting device in FIG. 8.

FIG. 7 is a perspective view showing a display device using a semiconductor light-emitting device according to another embodiment of the present disclosure, and FIG. 8 is a cross-sectional view taken along line C-C in FIG. 7, and FIG. 9 is a conceptual view showing a vertical semiconductor light-emitting emitting device in FIG. 8.

According to the drawings, the display device may be display device using a passive matrix (PM) type of vertical semiconductor light-emitting device.

The display device may include a substrate 210, a first electrode 220, a conductive adhesive layer 230, a second electrode 240 and a plurality of semiconductor light-emitting devices 250.

The substrate 210 as a wiring substrate disposed with the first electrode 220 may include polyimide (PI) to implement a flexible display device. In addition, any one may be used if it is an insulating and flexible material.

The first electrode 220 may be located on the substrate 210, and formed with a bar-shaped electrode elongated in one direction. The first electrode 220 may be formed to perform the role of a data electrode.

The conductive adhesive layer 230 is formed on the substrate 210 located with the first electrode 220. Similar to a display device to which a flip chip type light-emitting device is applied, the conductive adhesive layer 230 may be an anisotropic conductive film (ACF), an anisotropic conductive paste, a solution containing conductive particles, and the like. However, the present embodiment illustrates a case where the conductive adhesive layer 230 is implemented by an anisotropic conductive film.

When an anisotropic conductive film is located in a state that the first electrode 220 is located on the substrate 210, and then heat and pressure are applied to connect the semiconductor light-emitting device 250 thereto, the semiconductor light-emitting device 250 is electrically connected to the first electrode 220. At this time, the semiconductor light-emitting device 250 may be disposed to be placed on the first electrode 220.

The electrical connection is generated because an anisotropic conductive film partially has conductivity in the thickness direction when heat and pressure are applied as described above. Accordingly, the anisotropic conductive film is partitioned into a portion 231 having conductivity and a portion 232 having no conductivity in the thickness direction thereof.

Furthermore, the anisotropic conductive film contains an adhesive component, and thus the conductive adhesive layer 230 implements a mechanical coupling as well as an electrical coupling between the semiconductor light-emitting device 250 and the first electrode 220.

In this manner, the semiconductor light-emitting device 250 is placed on the conductive adhesive layer 230, thereby configuring a separate sub-pixel in the display device. The semiconductor light-emitting device 250 may have excellent luminance characteristics, and thus it may be possible to configure individual unit pixels even with a small size thereof. The size of the individual semiconductor light-emitting device 250 may be less than 80 μm in the length of one side thereof, and formed with a rectangular or square shaped element. In case of a rectangular shaped element, the size thereof may be less than 20×80 μm.

The semiconductor light-emitting device 250 may be a vertical structure.

A plurality of second electrodes 240 disposed in a direction of crossing the length direction of the first electrode 220, and electrically connected to the vertical semiconductor light-emitting device 250 may be located between vertical semiconductor light-emitting devices.

Referring to FIG. 9, the vertical semiconductor light-emitting device may include a p-type electrode 256, a p-type semiconductor layer 255 formed with the p-type electrode 256, an active layer 254 formed on the p-type semiconductor layer 255, an n-type semiconductor layer 253 formed on the active layer 254, and an n-type electrode 252 formed on the n-type semiconductor layer 253. In this case, the p-type electrode 256 located at the bottom thereof may be electrically connected to the first electrode 220 by the conductive adhesive layer 230, and the n-type electrode 252 located at the top thereof may be electrically connected to the second electrode 240 which will be described later. The electrodes may be disposed in the upward/downward direction in the vertical semiconductor light-emitting device 250, thereby providing a great advantage capable of reducing the chip size.

Referring again to FIG. 8, a phosphor layer 280 may be formed on one surface of the semiconductor light-emitting device 250. For example, the semiconductor light-emitting device 250 is a blue semiconductor light-emitting device 251 that emits blue (B) light, and the phosphor layer 280 for converting the blue (B) light into the color of the sub-pixel may be provided thereon. In this case, the phosphor layer 280 may be a red phosphor 281 and a green phosphor 282 constituting individual pixels.

In other words, a red phosphor 281 capable of converting blue light into red (R) light may be deposited on the blue semiconductor light-emitting device 251 at a position implementing a red sub-pixel, and a green phosphor 282 capable of converting blue light into green (G) light may be deposited on the blue semiconductor light-emitting device 251 at a position implementing a green sub-pixel. Furthermore, only the blue semiconductor light-emitting device 251 may be solely used at a location implementing a blue sub-pixel. In this case, the red (R), green (G) and blue (B) sub-pixels may implement one pixel.

However, the present disclosure may not be necessarily limited to this, and another structure for implementing blue, red and green may be also applicable thereto as described above in a display device to which a flip chip type light-emitting device is applied.

Taking the present embodiment into consideration again, the second electrode 240 is located between the semiconductor light-emitting devices 250, and electrically connected to the semiconductor light-emitting devices 250. For example, the semiconductor light-emitting devices 250 may be disposed in a plurality of rows, and the second electrode 240 may be located between the rows of the semiconductor light-emitting devices 250.

Since a distance between the semiconductor light-emitting devices 250 constituting individual pixels is sufficiently large, the second electrode 240 may be located between the semiconductor light-emitting devices 250.

The second electrode 240 may be formed with a bar-shaped electrode elongated in one direction, and disposed in a perpendicular direction to the first electrode.

Furthermore, the second electrode 240 may be electrically connected to the semiconductor light-emitting device 250 by a connecting electrode protruded from the second electrode 240. More specifically, the connecting electrode may be an n-type electrode of the semiconductor light-emitting device 250. For example, the n-type electrode is formed with an ohmic electrode for ohmic contact, and the second electrode covers at least part of the ohmic electrode by printing or deposition. Through this, the second electrode 240 may be electrically connected to the n-type electrode of the semiconductor light-emitting device 250.

According to the drawing, the second electrode 240 may be located on the conductive adhesive layer 230. According to circumstances, a transparent insulating layer (not shown) containing silicon oxide (SiOx) may be formed on the substrate 210 formed with the semiconductor light-emitting device 250. When the transparent insulating layer is formed and then the second electrode 240 is placed thereon, the second electrode 240 may be located on the transparent insulating layer. Furthermore, the second electrode 240 may be formed to be separated from the conductive adhesive layer 230 or transparent insulating layer.

If a transparent electrode such as indium tin oxide (ITO) is used to locate the second electrode 240 on the semiconductor light-emitting device 250, the ITO material has a problem of bad adhesiveness with an n-type semiconductor. Accordingly, the second electrode 240 may be placed between the semiconductor light-emitting devices 250, thereby obtaining an advantage in which the transparent electrode is not required. Accordingly, an n-type semiconductor layer and a conductive material having a good adhesiveness may be used as a horizontal electrode without being restricted by the selection of a transparent material, thereby enhancing the light extraction efficiency.

According to the drawing, a partition wall 290 may be formed between the semiconductor light-emitting devices 250. In other words, the partition wall 290 may be disposed between the vertical semiconductor light-emitting devices 250 to isolate the semiconductor light-emitting device 250 constituting individual pixels. In this case, the partition wall 290 may perform the role of dividing individual sub-pixels from one another, and be formed as an integral body with the conductive adhesive layer 230. For example, a base member of the anisotropic conductive film may form the partition wall when the semiconductor light-emitting device 250 is inserted into the anisotropic conductive film.

Furthermore, when the base member of the anisotropic conductive film is black, the partition wall 290 may have reflective characteristics while at the same time increasing contrast with no additional black insulator.

For another example, a reflective partition wall may be separately provided with the partition wall 290. The partition wall 290 may include a black or white insulator according to the purpose of the display device.

If the second electrode 240 is precisely located on the conductive adhesive layer 230 between the semiconductor light-emitting devices 250, the partition wall 290 may be located between the vertical semiconductor light-emitting device 250 and second electrode 240. Accordingly, individual unit pixels may be configured even with a small size using the semiconductor light-emitting device 250, and a distance between the semiconductor light-emitting devices 250 may be relatively sufficiently large to place the second electrode 240 between the semiconductor light-emitting devices 250, thereby having the effect of implementing a flexible display device having a HD image quality.

Furthermore, according to the drawing, a black matrix 291 may be disposed between each phosphor layer to enhance contrast. In other words, the black matrix 291 can enhance the contrast of luminance.

As described above, the semiconductor light-emitting device 250 is located on the conductive adhesive layer 230, thereby constituting individual pixels on the display device. The semiconductor light-emitting device 250 may have excellent luminance characteristics, and thus it may be possible to configure individual unit pixels even with a small size thereof. As a result, it may be possible to implement a full color display in which the semiconductor light-emitting devices of red (R), green (G) and blue (B) implement a sub-pixel (or pixel) by means of the semiconductor light-emitting devices.

Hereinafter, a display device using the semiconductor light-emitting diode or OLED will be described with reference to FIG. 10.

Figure 10:
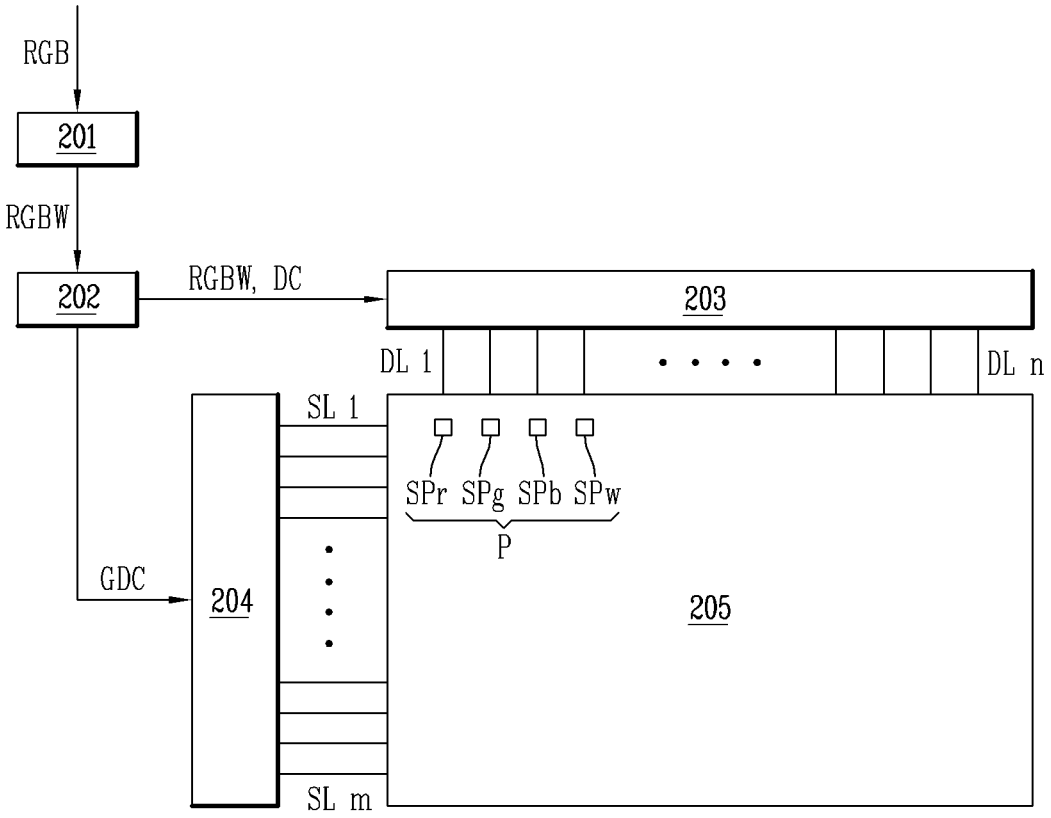
FIG. 10 is a configuration diagram showing a display device using a semiconductor light-emitting diode (LED) according to an embodiment of the present disclosure.

FIG. 10 is a block diagram showing a display device using a semiconductor light-emitting diode (LED) to which a display panel driving device according to an embodiment of the present disclosure is applied.

As shown in FIG. 10, a display device using a semiconductor light-emitting diode (LED) according to an embodiment of the present disclosure is includes an image processing unit 201, a timing controller 202, a data driving unit 203, a scan driving unit 204, and a display panel 205 including a plurality of light-emitting diodes (LEDs).

The image processing unit 201 receives a vertical synchronization signal, a horizontal synchronization signal, a data enable signal, a clock signal, and red, green, and blue signals (RGB) (hereinafter, referred to as RGB) from the outside. The image processing unit 201 converts RGB signals (RGB) into red, green, blue, and white (RGBW) signals (hereinafter, referred to as RGBW) and outputs the converted signals to the timing controller 202. The image processing unit 201 varies a gamma voltage to implement a peak luminance according to an average image level using RGB signals (RGB) included in one frame data supplied from the outside. The image processing unit 201 variously processes frame data received from the outside, and detailed description thereof will be omitted since it is publicly known technology.

The timing controller 202 receives a vertical synchronization signal, a horizontal synchronization signal, a data enable signal, a clock signal, and RGBW signals (RGBVV) from the image processing unit 201.

The timing controller 202 controls the operation timings of the data driving unit 203 and the scan driving unit 204 using timing signals such as a vertical synchronization signal, a horizontal synchronization signal, a data enable signal, and a clock signal. The timing controller 202 may count the data enable signal of one horizontal period to determine a frame period, and thus the vertical synchronization signal and the horizontal synchronization signal supplied from the outside may be omitted. The control signals generated by the timing controller 202 include a gate timing control signal (GDC) for controlling the operation timing of the scan driving unit 204 and a data timing control signal (DDC) for controlling the operation timing of the data driving unit 203. The gate timing control signal (GDC) includes a gate start pulse, a gate shift clock, a gate output enable signal, and the like. The data timing control signal (DDC) includes a source start pulse, a source sampling clock, and a source output enable signal.

The data driving unit 203 samples and latches RGBW signals (RGBW) supplied from the timing controller 202 in response to the data timing control signal (DDC) received from the timing controller 202 to convert the latched signals into data in a parallel data system. When converting into the data of the parallel data system, the data driving unit 203 converts RGBW signals (RGBVV) from digital data to analog data according to a gamma voltage. At this time, converting digital data into analog data is carried out by a digital-to-analog converter (DAC) included in the data driving unit 203. The data driving unit 203 supplies an image signal (DATA) converted through data lines (DL1-DLn) to sub-pixels (SPr, SPg, SPb, SPw) included in the display panel 205.

In response to the gate timing control signal (GDC) supplied from the timing controller 202, the scan driving unit 204 sequentially generates scan signals while shifting a level of signal to a swing width of a gate driving voltage at which the transistors of the sub-pixels (SPr, SPg, SPb, SPw) included in the display panel 205 can operate. The scan driving unit 204 supplies a scan signal generated through the scan lines (SL1-SLm) to the sub-pixels (SPr, SPg, SPb, SPw) included in the display panel 205.

The display panel 205 is composed of an organic light-emitting display panel including sub-pixels (SPr, SPg, SPb, SPw) arranged in a matrix form. The sub-pixels (SPr, SPg, SPb, SPw) include a red sub-pixel (SPr), a green sub-pixel (SPg), a blue sub-pixel (SPb), and a white sub-pixel (SPw), which become one pixel (P).

In general, in order to drive an LED array as a display, a passive matrix (PM) mode and an active matrix (AM) mode are used. The AM mode memorizes a value of each pixel until the end of one frame to maintain light, but the PM mode turns on rapidly in sequence in line units to make it look like a single image using a visual afterimage effect (lasting about 1/10 second).

Hereinafter, a drive device of an LED display using a driving unit (e.g., micro-IC) for digital PWM (pulse width modulation) driving will be described with reference to FIG. 11.

Figure 11:
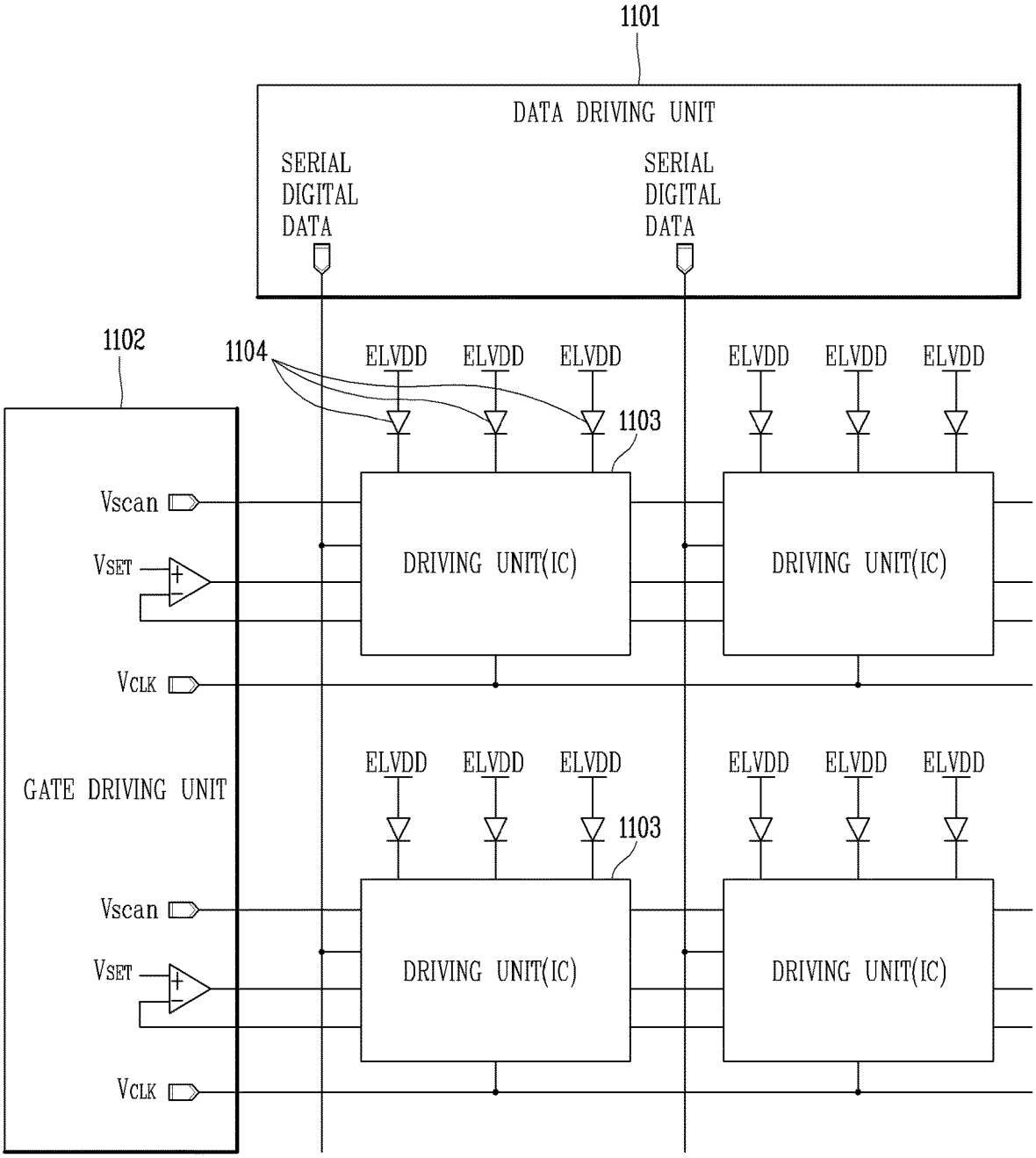
FIG. 11 is a configuration diagram showing a drive device of an LED display using a driving unit (e.g., micro-IC) for digital pulse width modulation (PWM) driving according to an embodiment of the present disclosure.

FIG. 11 is a block diagram showing a drive device of an LED display using a driving unit (e.g., micro-IC) for digital pulse width modulation (PWM) driving according to an embodiment of the present disclosure.

As shown in FIG. 11, a drive device of an LED display using a driving unit (e.g., micro-IC) for digital PWM (pulse width modulation) driving according to an embodiment of the present disclosure includes:

a plurality of light-emitting diodes (LEDs) 1104 applied to sub-pixels included in a display panel;

a data driving unit 1101 that generates serial digital data for driving the plurality of light-emitting diodes (LEDs) 1104;

a gate driving unit 1102 that generates a driving signal for driving the plurality of light-emitting diodes (LEDs) 1104 in response to a scan signal ($V_{scan}$); and a driving unit 1103 that drives in a digital pulse width modulation (PWM) mode, and drives the plurality of light-emitting diodes (LEDs) 1104 based on the serial digital data and the driving signal.

The driving unit 1103 is a micro-IC, which includes a pulse width modulation (PWM) generation unit.

The data driving unit 1101 applies luminance information (serial digital data) of the plurality of light-emitting diodes (LEDs) 1104 to the plurality of light-emitting diodes (LEDs) 1104 through the driving unit 1103.

The gate driving unit 1102 controls a current level of a micro-IC, and selects an input order of data, and counts light emission times of the plurality of light-emitting diodes (LEDs) 1104.

The data driving unit 1101 applies serial digital data as it is to the plurality of light-emitting diodes (LEDs) 1104 through the driving unit 1103, and thus a digital-to-analog converter (DAC) that converts digital data into analog data is not required.

Since the micro-IC 1103 according to an embodiment of the present disclosure transmits serial digital data to the plurality of light-emitting diodes (LEDs) 1104 in a digital mode, and uses a digital comparator using the digital data as it is, a size of the micro-IC 1103 may be made smaller than that of a circuit using analog data.

Furthermore, the data driving unit 1101 according to an embodiment of the present disclosure may transfer digital data as it is to the plurality of light-emitting diodes (LEDs) 1104, thereby allowing an integrated circuit of the data driving unit 1101 to be made smaller in size than that of a circuit using analog data.

Since a drive device of an LED display using a driving unit (e.g., micro-IC) for digital pulse width modulation (PWM) driving according to an embodiment of the present disclosure does not use a thin film transistor (TFT), power consumption is low due to a low power supply voltage to a pixel, and parasitic resistance (R) and capacitance (C) may be made small due to a high degree of freedom of the metal process.

Hereinafter, according to the present disclosure, a drive device for an LED display using a driving unit (e.g., micro-IC) for digital PWM (pulse width modulation) driving will be described with reference to FIG. 11.

Figure 12:
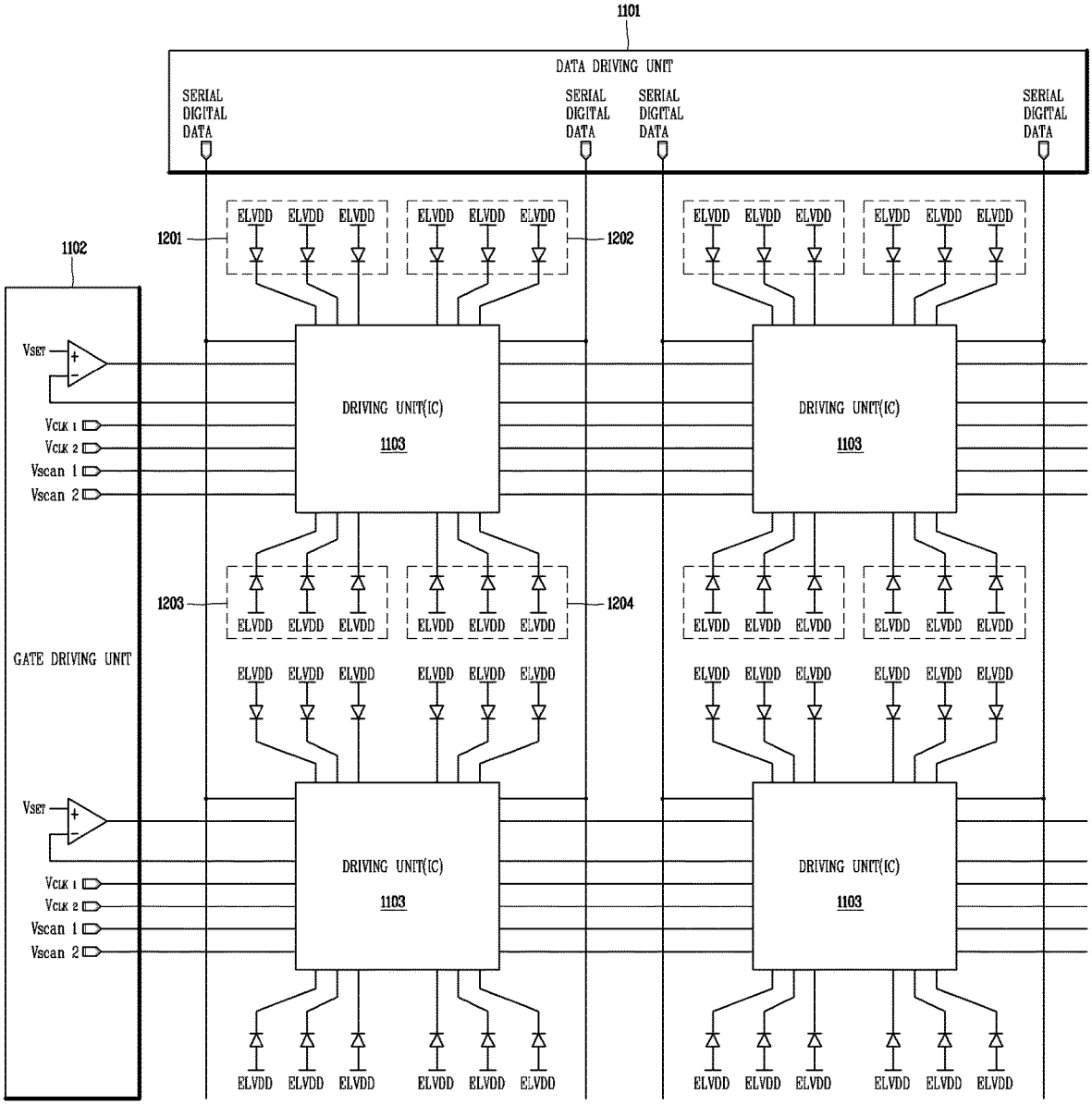
FIG. 12 is a configuration diagram showing a drive device of an LED display using a driving unit (e.g., micro-IC) for digital pulse width modulation (PWM) driving according to another embodiment of the present disclosure.

FIG. 12 is a configuration diagram showing a drive device of an LED display that drives a plurality of pixels (one pixel includes a plurality of sub-pixels) using a single driving unit (e.g., micro-IC), as a configuration diagram showing a drive device of an LED display using a driving unit (e.g., micro-IC) for digital pulse width modulation (PWM) driving according to another embodiment of the present disclosure.

As illustrated in FIG. 12, a drive device for an LED display using a driving unit (e.g., micro-IC) for digital PWM (pulse width modulation) driving according to another embodiment of the present disclosure includes:

a plurality of light-emitting diodes (LEDs) 1201 to 1204 applied to a plurality of pixels (e.g., 2 to 4 pixels) included in a display panel;

a data driving unit 1101 that generates serial digital data for driving the plurality of light-emitting diodes (LEDs) 1201 to 1204;

a gate driving unit 1102 generating a driving signal for driving the plurality of light-emitting diodes (LEDs) 1201 to 1204 in response to a scan signal ($V_{scan}$), and a single driving unit 1103 that drives in a digital pulse width modulation (PWM) mode, and drives the plurality of light-emitting diodes (LEDs) 1201 to 1204 applied to multiple pixels based on the serial digital data and the driving signal.

The driving unit 1103 is a micro-IC, which includes a pulse width modulation (PWM) generation unit.

The single driving unit 1103 may drive sub-pixels (a plurality of light-emitting devices) applied to one pixel, or may drive sub-pixels (a plurality of light-emitting devices) applied to a plurality of pixels.

Figure 13:
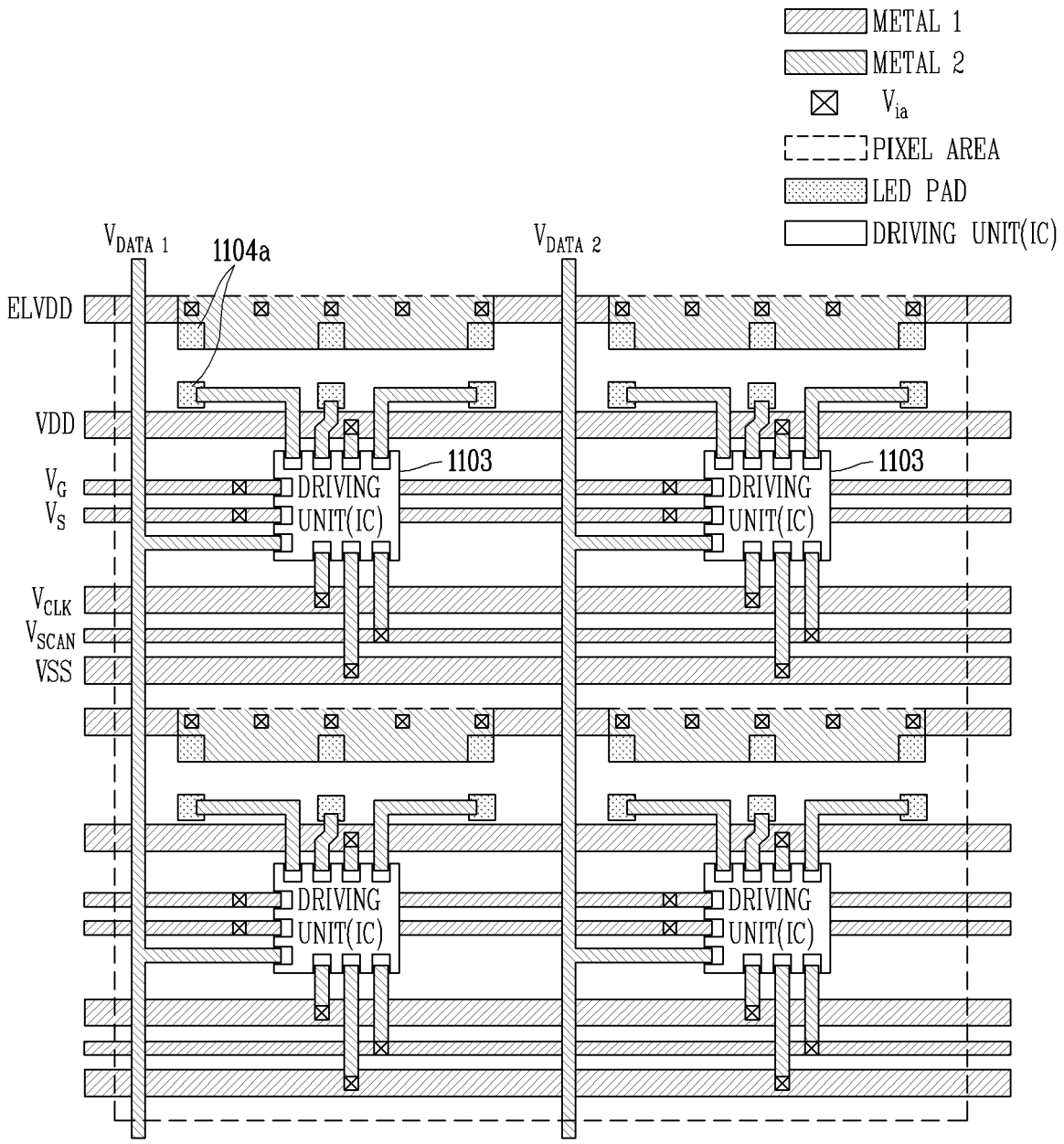
FIG. 13 is an exemplary view schematically showing a manufacturing method fora drive device of the LED (Light Emitting Diode) display in FIG. 11.

FIG. 13 is an exemplary view schematically showing a manufacturing method fora drive device of the LED (Light Emitting Diode) display in FIG. 11.

As illustrated in FIG. 13, the driving unit 1103 that drives the plurality of light-emitting diodes (LEDs) 1104 is electrically connected to a pad (LED pad) 1104*a*, and the plurality of light-emitting diodes (LEDs) 1104 are electrically connected to the pad (LED pad) 1104*a*.

The driving unit 1103 may be connected to the pad (LED pad) 1104*a* through a metal line (Metal 2) such as gold or silver, and a driving voltage for driving the plurality of light-emitting diodes (LEDs) 1104 (e.g., VDD, $V_G$, $V_S$, etc.) may be connected to the driving unit 1103 through a metal line (Metal 1) such as copper or aluminum.

The driving unit 1103 may be connected to semiconductor light-emitting devices applied to a red sub-pixel (SPr), a green sub-pixel (SPg), a blue sub-pixel (SPb), and a white sub-pixel (SPw) corresponding to one pixel, or a red sub-pixel (SPr), a green sub-pixel (SPg), and a blue sub-pixel (SPb) corresponding to one pixel, respectively.

Figure 14:
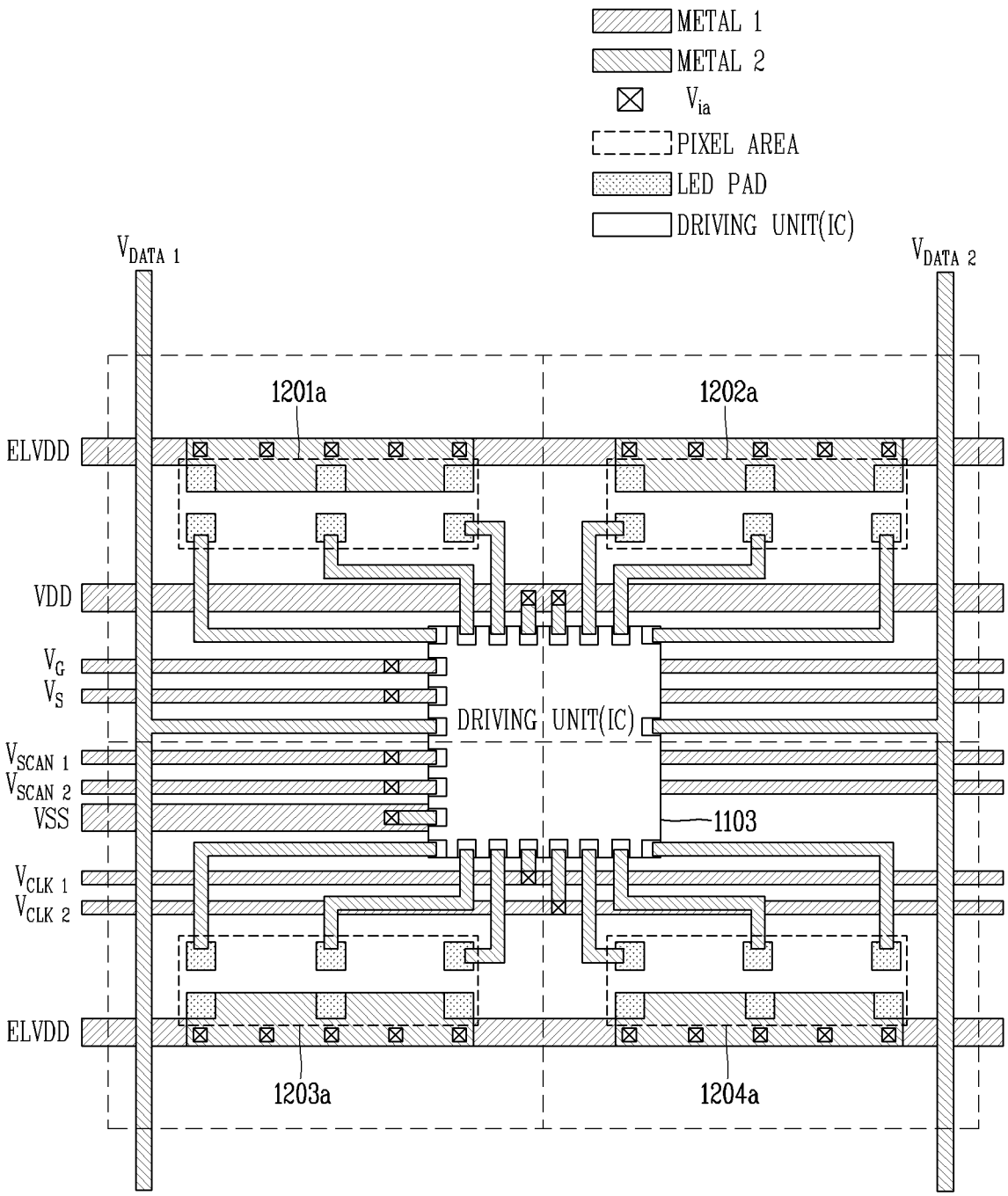
FIG. 14 is an exemplary view schematically showing a manufacturing method fora drive device of the LED (Light Emitting Diode) display in FIG. 12.

FIG. 14 is an exemplary view schematically showing a manufacturing method fora drive device of the LED (Light Emitting Diode) display in FIG. 12.

As illustrated in FIG. 14, the single driving unit 1103 that drives a plurality of light-emitting diodes (LEDs) 1104 is electrically connected to pads (LED pads) 1201*a* to 1204*a* electrically connected to light-emitting diodes (LEDs) 1201 applied to a plurality of pixels (e.g., four pixels) included in a display panel. The single driving unit 1103 may be connected to pads (LED pads) 1201*a* to 1204*a* through a metal line such as gold or silver, and a driving voltage (e.g., VDD, $V_G$, $V_S$, etc.) for driving the plurality of light-emitting diodes (LEDs) 1201 to 1204 may be connected to the driving unit 1103 through a metal line such as copper or aluminum. The driving unit 1103 may be connected to semiconductor light-emitting devices applied to a red sub-pixel (SPr), a green sub-pixel (SPg), a blue sub-pixel (SPb), and a white sub-pixel (SPw) corresponding to one pixel, or a red sub-pixel (SPr), a green sub-pixel (SPg), and a blue sub-pixel (SPb) corresponding to one pixel, respectively.

Hereinafter, a drive device of an LED display that compensates for a current flowing through a plurality of light-emitting diodes (LEDs) applied to sub-pixels included in a display panel will be described with reference to FIGS. 15 and 16.

Figure 15:
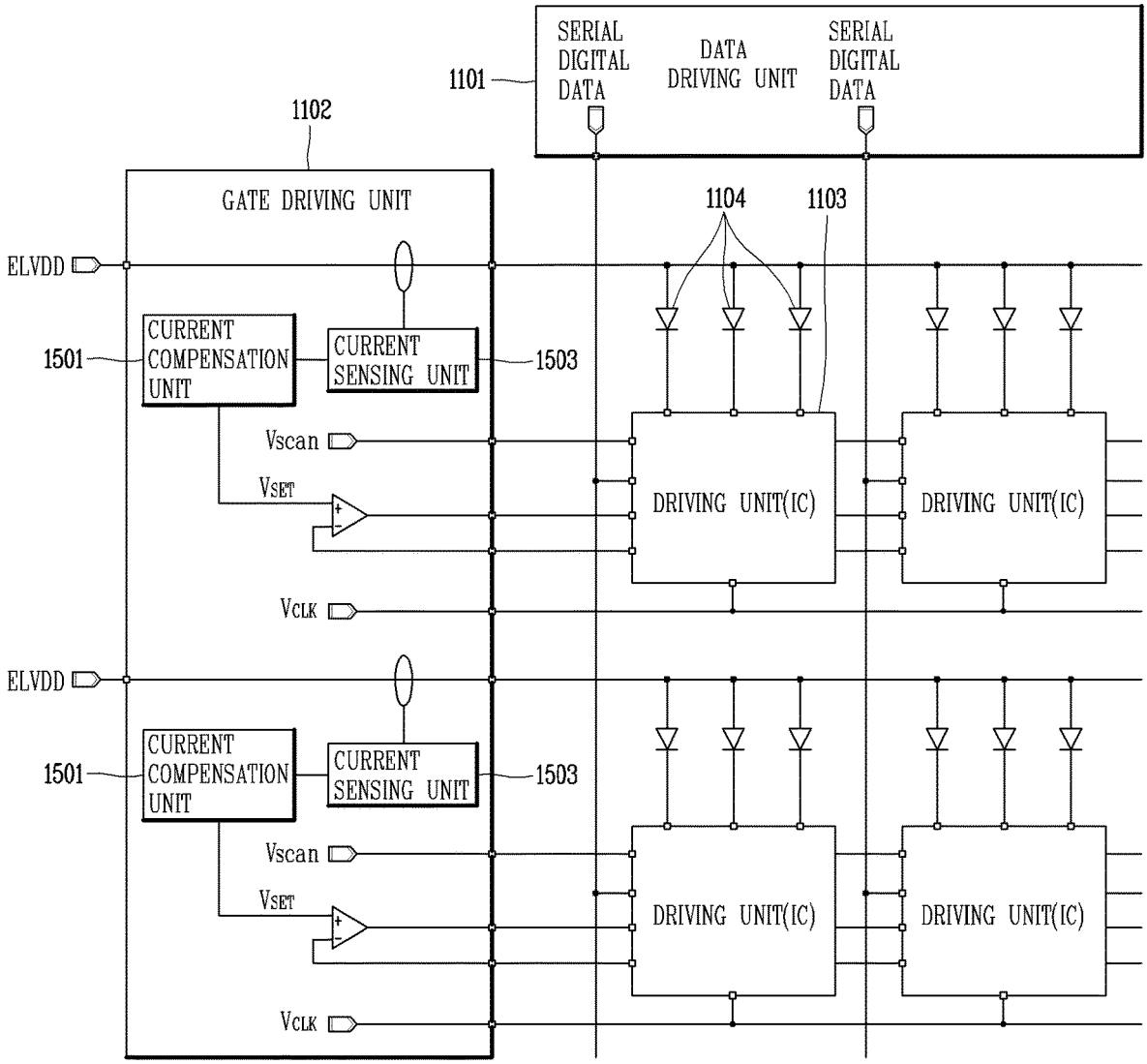
FIGS. 15 and 16 are configuration diagrams showing a drive device of an LED display that compensates for a current flowing through a plurality of light-emitting diodes (LEDs) applied to sub-pixels included in a display panel according to another embodiment of the present disclosure.
Figure 16:
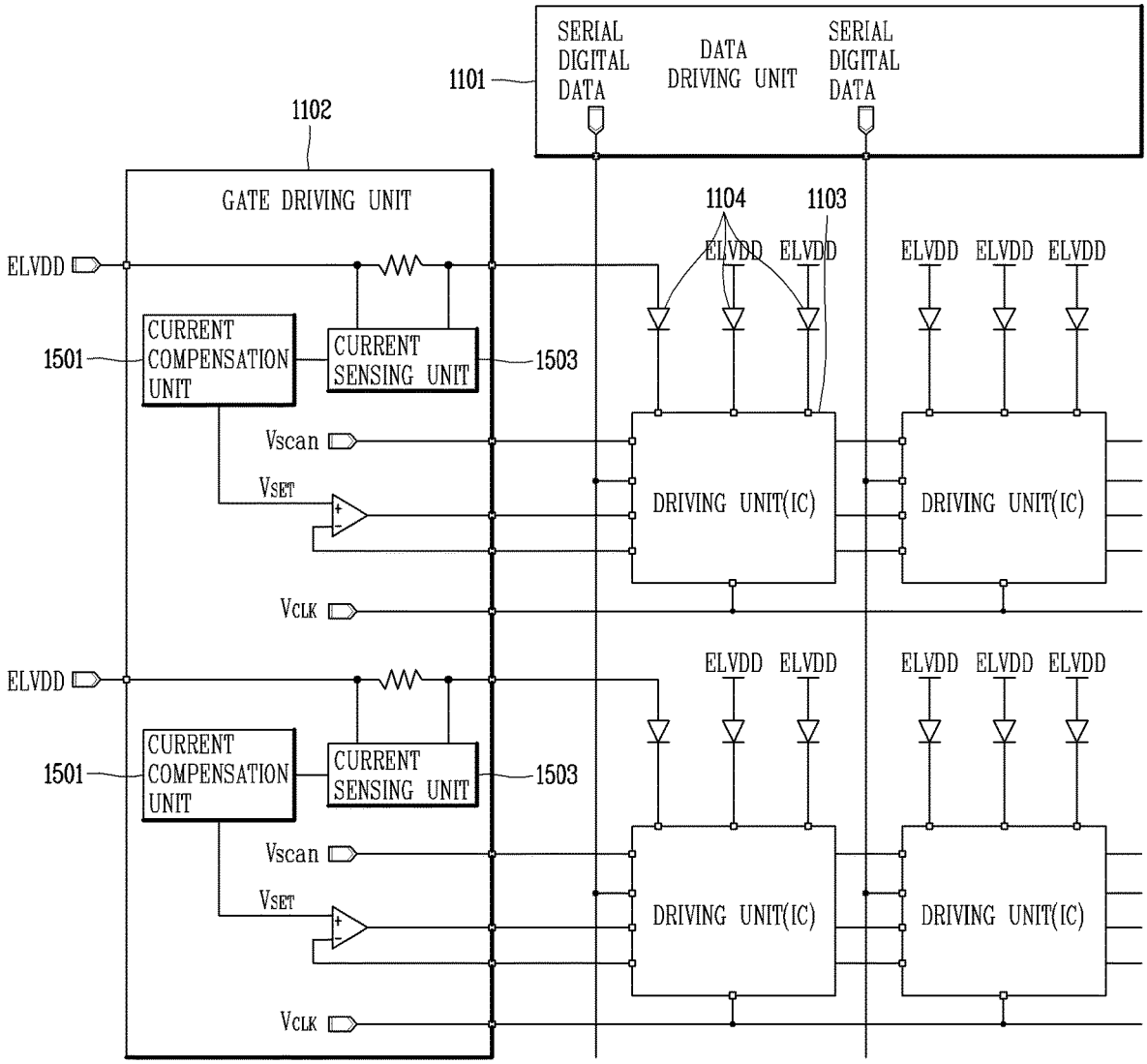

FIGS. 15 and 16 are configuration diagrams showing a drive to device of an LED display that compensates for a current flowing through a plurality of light-emitting diodes (LEDs) applied to sub-pixels included in a display panel according to another embodiment of the present disclosure.

As illustrated in FIGS. 15 and 16, a drive device of an LED display according to still another embodiment of the present disclosure includes:

a plurality of light-emitting diodes (LEDs) 1104 applied to sub-pixels included in a display panel, a data driving unit 1101 that generates serial digital data for driving the plurality of light-emitting diodes (LEDs) 1104, a gate driving unit 1102 that generates a driving signal for driving the plurality of light-emitting diodes (LEDs) 1104 in response to a scan signal ($V_{scan}$), a driving unit 1103 that drives in a digital PWM (pulse width modulation) mode, and drives the plurality of semiconductor light-emitting diodes based on the serial digital data and the driving signal, and the driving unit 1103 may include a current sensing unit 1503 that senses a current value flowing through at least one of the plurality of semiconductor light-emitting diodes, and a current compensation unit 1501 that compensates for a current deviation between the plurality of semiconductor-light-emitting diodes based on the current value sensed by the current sensing unit.

Here, the current sensing unit 1503 may sense a value of a current flowing through whole sub-pixels as shown in FIG. 15 or may sense a value of current flowing through any one semiconductor light-emitting device among the sub-pixels as shown in FIG. 16.

For example, the current sensing unit 1503 detects a current flowing through at least one or more of the semiconductor light-emitting diodes (LEDs) 1104 (e.g., LEDs applied to red sub-pixels) in real time, and the current compensating unit 1501 adjusts a set voltage ($V_{ASET}$) applied to an operational amplifier 1502 such that a preset reference current flows through any one of the semiconductor light-emitting devices so as to allow the current flowing through the semiconductor light-emitting diodes (LEDs) 1104 to always become the preset reference current when the sensed current value is different from the preset reference current.

The operational amplifier 1502 receives a voltage applied to the plurality of light-emitting diodes (LEDs) 1104 and the set voltage ($V_{ASET}$), and applies a difference between the voltage applied to the plurality of light-emitting diodes (LEDs) 1104 and the set voltage ($V_{ASET}$) to the driving unit 1103. A value of the current flowing through the semiconductor light-emitting device varies according to a voltage value of the set voltage ($V_{ASET}$).

The set voltage ($V_{ASET}$) may be input to a non-inverting input terminal (+) of the operational amplifier 1502, and the voltage applied to the plurality of light-emitting diodes (LEDs) 1104 may be input to an inverting input terminal (−) of the operational amplifier 1502.

The data driving unit 1101 applies luminance information of the plurality of light-emitting diodes (LEDs) 1104 to the plurality of light-emitting diodes (LEDs) 1104 through the driving unit 1103.

The gate driving unit 1102 controls a current level of a micro-IC, and selects an input order of data, and counts light emission times of the plurality of light-emitting diodes (LEDs) 1104.

Since the micro-IC 1103 according to another embodiment of the present disclosure transmits serial digital data to the plurality of light-emitting diodes (LEDs) 1104 in a digital mode, and uses a digital comparator using the digital data as it is, a size of the micro-IC 1103 may be made smaller than that of a circuit using analog data.

Furthermore, the data driver 1101 according to another embodiment of the present disclosure may transfer digital data as it is to the plurality of light-emitting diodes (LEDs) 1104, thereby allowing an integrated is circuit of the data driver 1101 to be made smaller in size than that of a circuit using analog data.

As described above, a drive device of an LED display according to embodiments of the present disclosure may eliminate the need for driving TFT (thin film transistor) compensation required in a semiconductor (oxide and LTPS (low temperature poly silicon, etc.) substrate backplane process, and reduce a power supply voltage (ELVDD) for driving pixels.

A drive device of an LED display according to embodiments of the present disclosure may allow data input at a low voltage. For example, a silicon-based transistor having high mobility may be used, thereby reducing power consumption when writing data.

A drive device of an LED display according to embodiments of the present disclosure may eliminate the need for a digital-to-analog converter (DAC) for converting digital data into analog data in a data driving unit. For example, a drive device of an LED display according to embodiments of the present disclosure may apply data in a digital mode, and thus a digital-to-analog converter (DAC) is not required in a data driving unit.

A drive device of the LED display according to embodiments of the present disclosure may eliminate the need for a digital-to-analog converter (DAC) in a data driving unit, thereby reducing a size of the data driving unit.

A drive device of an LED display according to embodiments of the present disclosure may compensate for a current deviation between a current flowing through a semiconductor light-emitting device applied to a sub-pixel in a display panel and a reference current.

A drive device of an LED display according to the embodiments of the present disclosure may secure a wide current range, and be applicable to a tiling display.

Meanwhile, when an offset occurs at an input voltage of the operational amplifier 1502 or a deviation occurs at a resistance, a current deviation between a plurality of light-emitting diodes (LEDs) applied to sub-pixels may occur. Therefore, a drive device of an LED display that compensates for a current deviation between a plurality of light-emitting diodes (LEDs) applied to sub-pixels included in a display panel will be described below with reference to FIG. 17.

Figure 17:
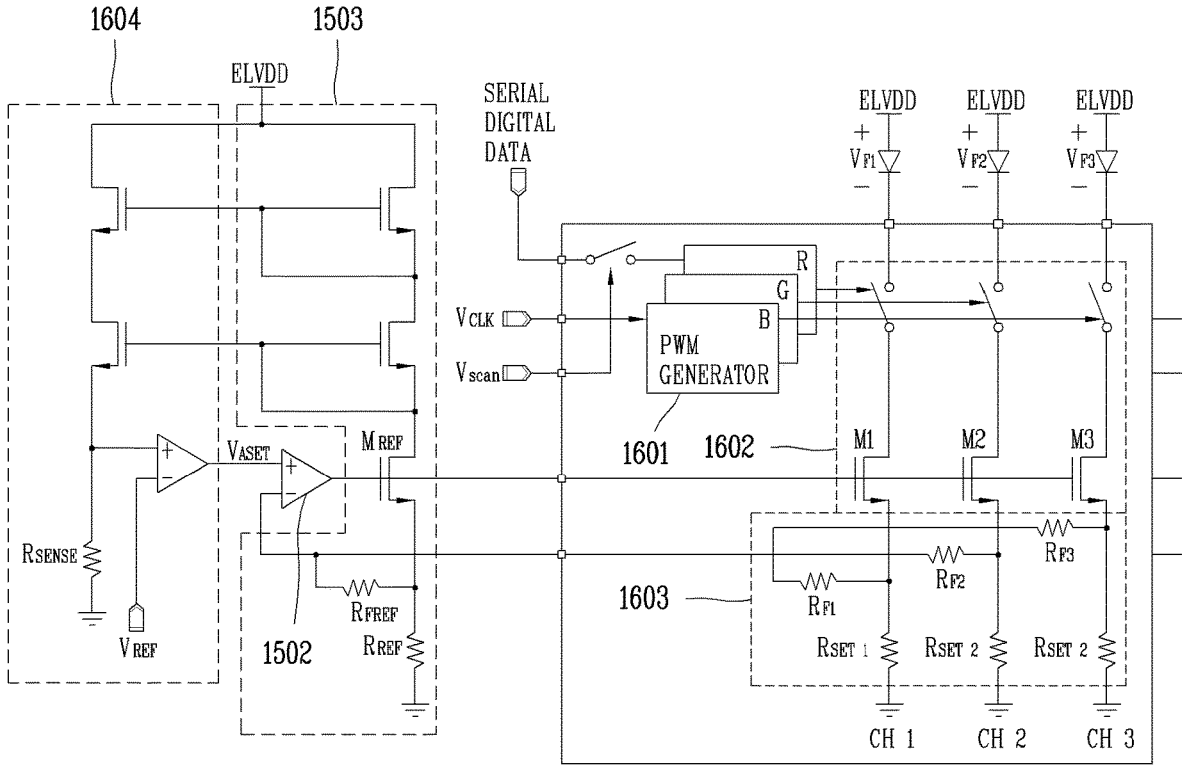
FIG. 17 is a block diagram showing a drive device of an LED display that compensates for a current deviation between a plurality of light-emitting diodes (LEDs) applied to sub-pixels included in a display panel according to another exemplary embodiment of the present disclosure.

FIG. 17 is a block diagram showing a drive device of an LED display that compensates for a current deviation between a plurality of light-emitting diodes (LEDs) applied to sub-pixels included in a display panel according to another exemplary embodiment of the present disclosure.

As illustrated in FIG. 17, a drive device of an LED display according to another embodiment of the present disclosure includes:

a plurality of light-emitting diodes (LEDs) 1104 applied to sub-pixels included in a display panel, a data driving unit 1101 that generates serial digital data for driving the plurality of light-emitting diodes (LEDs) 1104, a gate driving unit 1102 that generates a driving signal for driving the plurality of light-emitting diodes (LEDs) 1104 in response to a scan signal ($V_{scan}$), a driving unit 1103 that drives in a digital PWM (pulse width modulation) mode, and drives the plurality of light-emitting diodes (LEDs) based on the serial digital data and the driving signal, and the driving unit 1103 includes a PWM generation unit 1601 that generates a digital PWM signal, a switching unit 1602 connected each of the plurality of semiconductor light-emitting devices 1104 to switch the plurality of semiconductor light-emitting devices according to the digital PWM signal, and a current sensing unit 1503 that senses a value of a current value flowing through at least one of the plurality of semiconductor light-emitting devices.

In addition, the current compensation unit 1501 included in the driving unit 1103 includes a compensation unit 1603 connected between the switching unit 1602 and the ground to compensate for a current deviation between the plurality of semiconductor light-emitting devices 1104, and a variable reference generator 1604 that changes the set voltage according to a current value sensed by the current sensing unit 1503.

The compensation unit 1603 not only compensates for a current deviation between the plurality of light-emitting diodes (LEDs), but also determines a magnitude (value) of a current flowing through the plurality of light-emitting diodes (LEDs).

For example, the compensation unit 1603 includes a first resistor ($R_{SET1}$) connected in series to the switching unit 1602 connected in series to each of a plurality of light-emitting diodes (a plurality of LEDs applied to sub-pixels included in one pixel), and a second resistor (Rn) electrically connected between a point between the switching unit 1602 and the first resistor ($R_{SET1}$) and an inverting input terminal (−) of the operational amplifier 1502.

The switching unit 1602 includes a first switch connected in series to each of a plurality of light-emitting diodes (a plurality of LEDs applied to sub-pixels included in one pixel) to switch the plurality of light-emitting diodes (LEDs) according to a digital PWM signal, and a second switch (e.g., transistor (M1) connected in series between the first switch and the compensation unit 1603, and a gate of the second switch (e.g., transistor (M1)) is connected to an output terminal of the operational amplifier 1502. For example, the first switch (S1) that switches a first LED according to the digital PWM signal is connected in series to a first LED (e.g., an LED applied to a red sub-pixel), and the second switch (e.g., transistor (M1)) is electrically connected between the first switch (S1) and the compensation unit 1603. A third switch (S2) that switches a second LED according to a digital PWM signal is connected in series to the second LED (e.g., an LED applied to a green sub-pixel), and a fourth switch (e.g., transistor (M2)) is electrically connected between the third switch (S2) and the compensation unit 1603. A fifth switch (S3) that switches a third LED according to a digital PWM signal is connected in series to the third LED (e.g., an LED applied to a blue sub-pixel), and a sixth switch (e.g., transistor (M3)) is electrically connected between the fifth switch (S3) and the compensation unit 1603.

The compensation unit 1603 includes a resistor ($R_{SET1}$) connected in series to the second switch (e.g., transistor (M1)), a resistor ($R_{F1}$) electrically connected between a point between the second switch (e.g., transistor (M1)) and the resistor ($R_{SET1}$) and an inverting input terminal (−) of the operational amplifier 1502; a resistor ($R_{SET2}$) connected in series to a fourth switch (e.g., transistor (M2)), a resistor ($R_{F2}$) electrically connected between a point between the fourth switch (e.g., transistor (M2)) and the resistor ($R_{SET2}$) and an inverting to input terminal (−) of the operational amplifier 1502; and a resistor ($R_{SET3}$) connected in series to a sixth switch (e.g., transistor (M3)), and a resistor ($R_{F3}$) electrically connected between a point between the sixth switch (e.g., transistor (M3)) and the resistor ($R_{SET3}$) and an inverting input terminal (−) of the operational amplifier 1502.

On the other hand, the current sensing unit 1503 is connected to the sub-pixel and the variable reference generator 1604 to transmit a current ($I_{SENSE}$) equal to a current ($I_{LEDX}$) flowing through at least one of the semiconductor light-emitting devices applied to the sub-pixels to the variable reference generator 1604.

The variable reference generator 1604 adjusts $V_{ASET}$ so that $I_{SENSE}$ becomes $V_{REF}/R_{SENSE}$. Specifically, $V_{ASET}$ is adjusted as in Equation 1 below.

$$I_{LEDx} = V_{ASET} \Big/ \left( \frac{\sum_{k=1}^{n} R_{SETk}}{n} \right) = \frac{V_{REF}}{R_{SENSE}} \quad \text{[Equation 1]}$$

Specifically, when a condition as in Equation 2 below is satisfied, $I_{SENSE}$ becomes smaller than $V_{REF}/R_{SENSE}$. In this case, the variable reference generator increases $V_{ASET}$, and accordingly, a current flowing through a sub-pixel increases.

$$V_{ASET} \Big/ \frac{\sum_{k=1}^{n} R_{SETk}}{n} < \frac{V_{REF}}{R_{SENSE}} \quad \text{[Equation 2]}$$

On the contrary, when a condition as in Equation 3 below is satisfied, $I_{SENSE}$ becomes greater than $V_{REF}/R_{SENSE}$. In this case, the variable reference generator decreases $V_{ASET}$, and accordingly, a current flowing through to a sub-pixel decreases.

$$V_{ASET} \Big/ \frac{\sum_{k=1}^{n} R_{SETk}}{n} > \frac{V_{REF}}{R_{SENSE}} \quad \text{[Equation 3]}$$

Hereinafter, an embodiment of adjusting $V_{ASET}$ according to an average value of $R_{SET}$ will be described in detail.

Figure 18A:
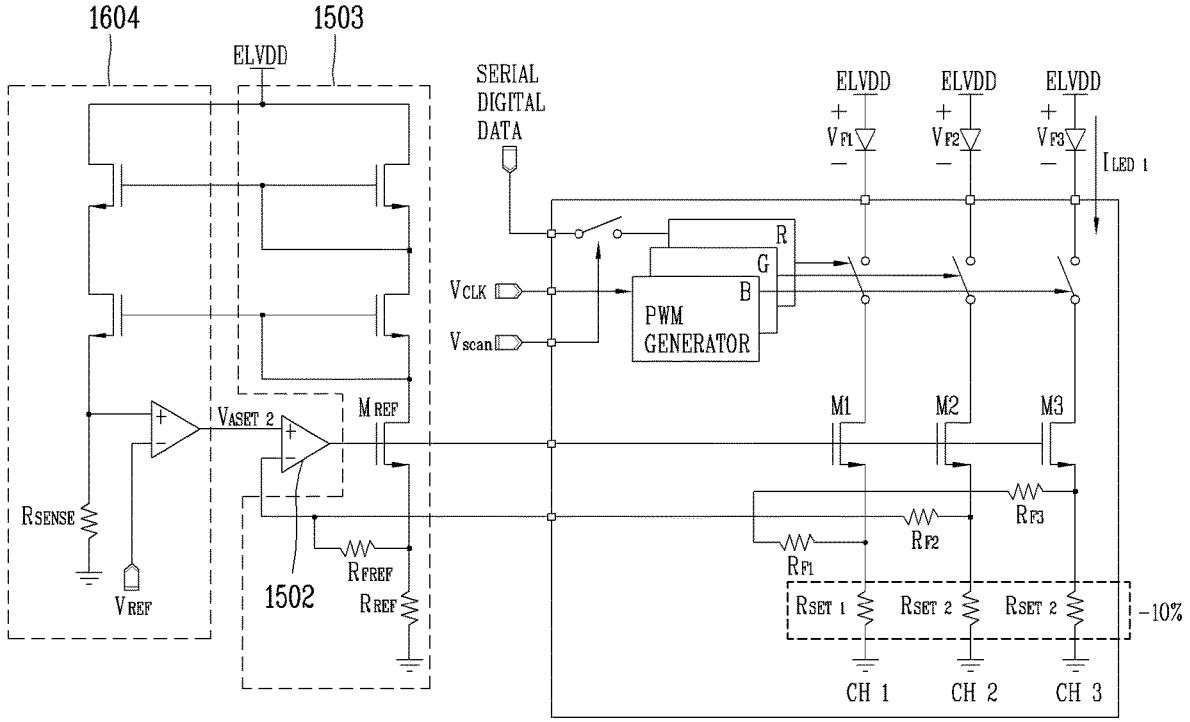
FIGS. 18A through 18C are configuration diagrams showing a drive device for an LED display having different average values of $R_{SET}$.
Figure 18B:
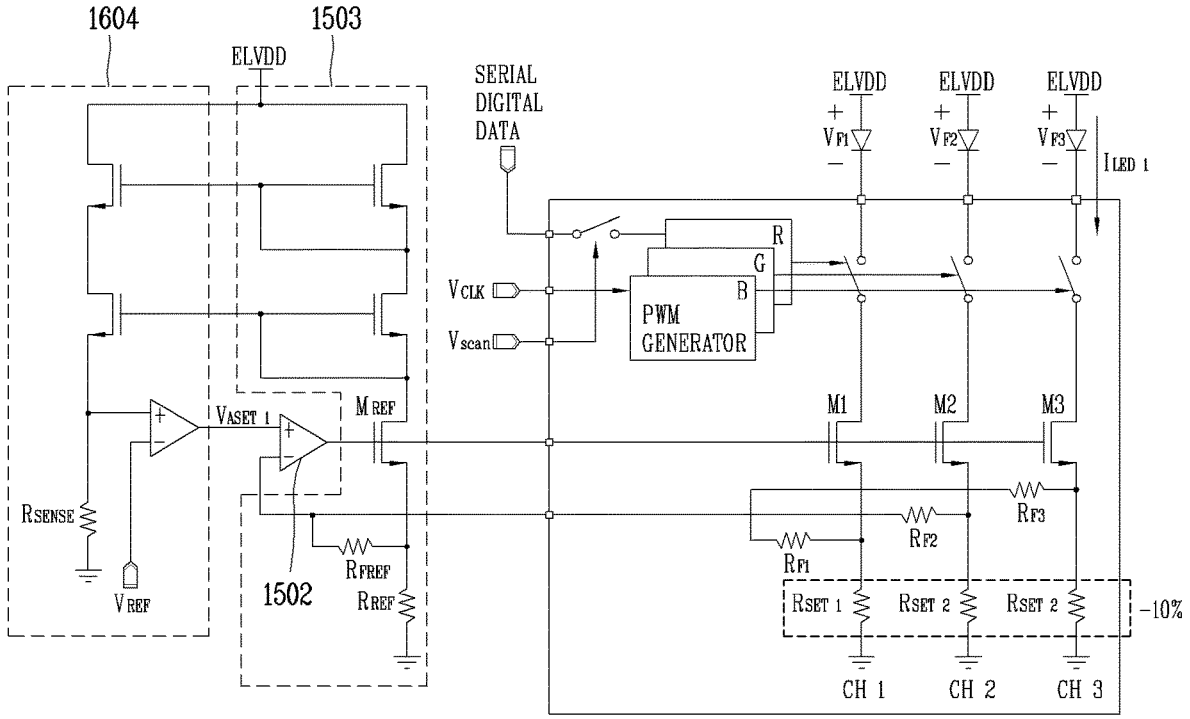
Figure 18C:
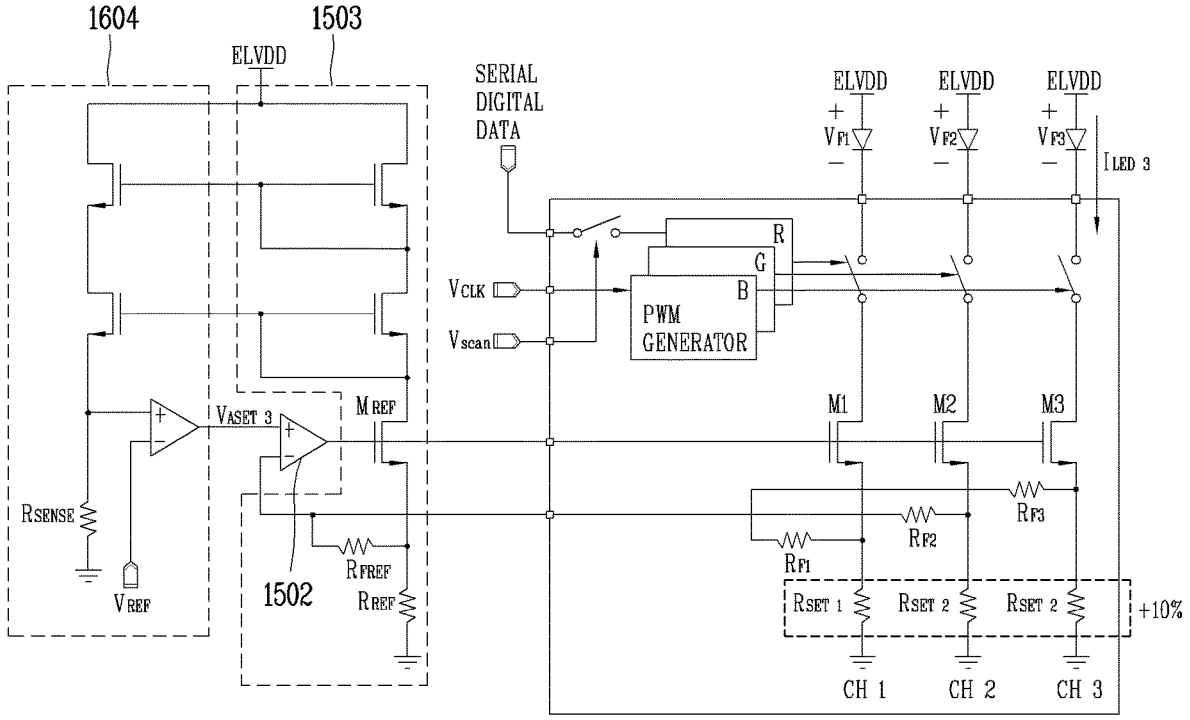
Figure 19:
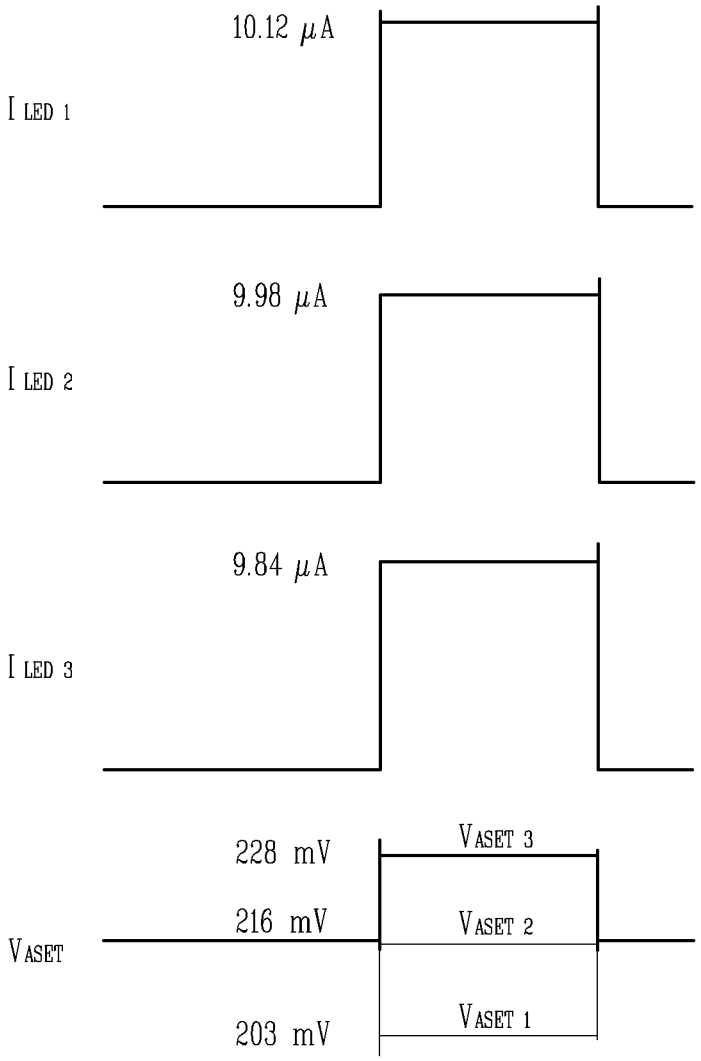
FIG. 19 is a graph showing a change in a value of $V_{ASET}$ according to a current flowing through a sub-pixel.

FIGS. 18A through 18C are configuration diagrams showing a drive device for an LED display having different average values of $R_{SET}$, and FIG. 19 is a graph showing a change in a value of $V_{ASET}$ according to a current flowing through a sub-pixel. In FIGS. 18A through 18C, $V_{ASET}$ is set to 216 mV.

FIG. 18A is a circuit in which $R_{SET}$ satisfies Equation 2. Referring to FIG. 19, a current $I_{LED1}$ flowing through a sub-pixel at this time was 10.12 μA. When a current of 10.12 μA flows through the variable reference unit 1604, the variable reference generator 1604 decreases a value of $V_{ASET1}$ from 216 mV to 203 mV to satisfy Equation 1. Accordingly, the current $I_{LED1}$ flowing through the sub-pixel decreases.

FIG. 18B is a circuit in which $R_{SET}$ satisfies Equation 1. Referring to FIG. 19, a current $I_{LED2}$ flowing through a sub-pixel at this time was 9.98 μA. Since the value of $V_{ASET2}$ already satisfies Equation 1, the variable reference generator 1604 maintains the set voltage at 216 mV so as not to change a current $I_{LED2}$ flowing through the sub-pixel.

FIG. 18C is a circuit in which $R_{SET}$ satisfies Equation 3. Referring to FIG. 19, a current $I_{LED1}$ flowing through a sub-pixel at this time was 9.84 μA. When a current of 9.84 pA flows through the variable reference generator 1604, the variable reference generator 1604 increases a value of $V_{ASET3}$ from 216 mV to 228 mV to satisfy Equation 1. Accordingly, a current $I_{LED3}$ flowing through a sub-pixel increases.

Hereinafter, an embodiment in which current compensation according to the present disclosure is applied for each line will be described.

Figure 20:
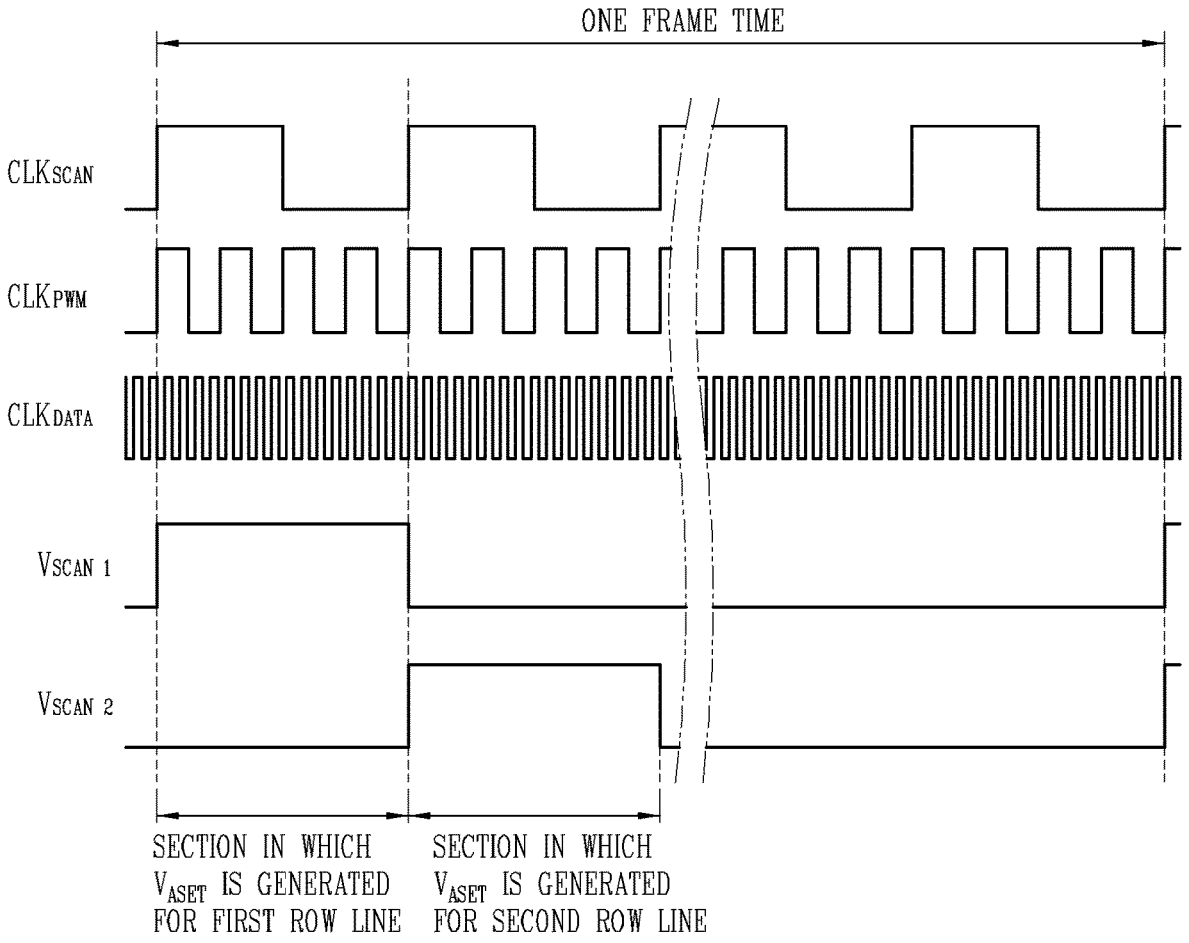
FIG. 20 is a timing chart showing an embodiment of performing current compensation for each line.

FIG. 20 is a timing chart showing an embodiment of performing current compensation for each line.

As shown in FIGS. 15 and 16, the operational amplifier 1502, the current sensing unit 1503, the compensation unit 1603, and the variable reference generator 1604 may be arranged for each row line of the display device. In this case, the display device corrects a current value for each row line.

The correction of the current value is not performed simultaneously on all lines, but may be performed sequentially for each line according to a $V_{scan}$ signal. For example, referring to FIG. 20, when a $V_{SCAN1}$ signal is 1, a $V_{ASET}$ signal for a first row line is generated, and when a $V_{SCAN2}$ signal is 1, a $V_{ASET}$ signal for a second row line is generated.

Hereinafter, a compensation unit that compensates for a current deviation between a plurality of light-emitting diodes (LEDs) applied to sub-pixels included in a display panel will be described with reference to FIG. 21.

Figure 21:
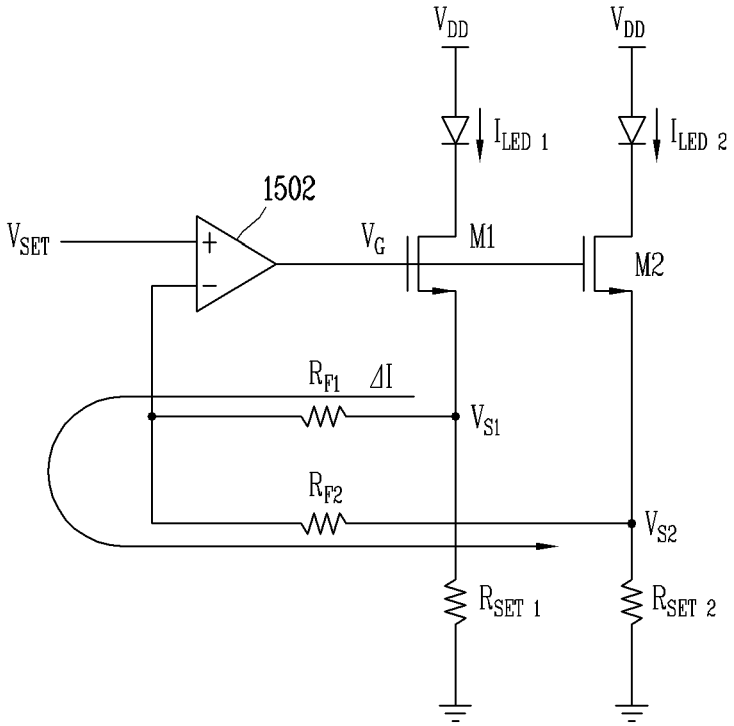
FIG. 21 is an exemplary view showing an operation of a compensator for compensating for a current deviation between a plurality of light-emitting diodes (LEDs) applied to sub-pixels included in a display panel according to still another embodiment of the present disclosure.

FIG. 21 is an exemplary view showing an operation of a compensator for compensating for a current deviation between a plurality of light-emitting diodes (LEDs) applied to sub-pixels included in a display panel according to still another embodiment of the present disclosure.

The compensation unit according to another embodiment of the present disclosure compensates for a current deviation between the plurality of light-emitting diodes (LEDs) according to an offset occurring at an input voltage of the operational amplifier 1502 or a resistance deviation between the plurality of light-emitting diodes (LEDs) themselves.

As shown in FIG. 17, assuming that there are a first resistor $R_{SET1}$ connected in series to a first switching unit (M1) that switches a first is semiconductor light-emitting device among a plurality of semiconductor light-emitting devices, and a second resistor ($R_{F1}$) electrically connected between a point between the first switching unit (M1) and the first resistor ($R_{SET1}$) and an input terminal of the operational amplifier 1502, a third resistor ($R_{SET2}$) connected in series to a second switching unit (M2) that switches a semiconductor light-emitting device among the plurality of semiconductor light-emitting devices, and a fourth resistor ($R_{F2}$) electrically connected between a point between the second switching unit (M2) and the third resistor ($R_{SET2}$) and an input terminal of the operational amplifier 1502, a current ($I_{LED1}$) flowing through the first semiconductor light-emitting device decreases while at the same time a voltage ($V_{S1}$) applied to the first semiconductor light-emitting device increases to generate a current deviation ($\Delta I$) when a resistance value of the first resistor ($R_{SET1}$) is higher than the third resistor ($R_{SET2}$). Accordingly, the compensation unit according to another embodiment of the present disclosure increases a current ($I_{LED1}$) flowing through the first semiconductor light-emitting device, and decreases a current ($I_{LED2}$) flowing through the second semiconductor light-emitting device, thereby compensating for a deviation between the current ($I_{LED1}$) flowing through the first semiconductor light-emitting device and the current ($I_{LED2}$) flowing through the second semiconductor light-emitting device.

For example, the compensation unit according to another embodiment of the present disclosure may include a first resistor ($R_{SET1}$) and a fourth resistor ($R_{F2}$) having the same resistance values; and a second resistor ($R_{F1}$) and a third resistor ($R_{SET2}$) having different resistance values to compensate for a deviation between the current ($I_{LED1}$) flowing through the first semiconductor is light-emitting device and the current ($I_{LED2}$) flowing through the second semiconductor light-emitting device.

As described above, a drive device of an LED display according to embodiments of the present disclosure may compensate for a current deviation between a plurality of semiconductor light-emitting devices applied to sub-pixels in a display panel, thereby improving the image quality of the display.

A drive device of an LED display according to embodiments of the present disclosure may compensate for a current deviation between a current flowing through a semiconductor light-emitting device applied to a sub-pixel in a display panel and a reference current, thereby further improving the image quality of the display.

A drive device of an LED display according to embodiments of the present disclosure may drive a digital panel in a digital PWM mode, and use serial digital data as it is, thereby eliminating the need for driving TFT (thin film transistor) compensation required in a semiconductor (oxide and LTPS (low temperature poly silicon), etc.) substrate backplane process, and reducing a power supply voltage (ELVDD) for driving pixels.

A drive device of an LED display according to embodiments of the present disclosure may drive a digital panel in a digital PWM mode, and use serial digital data as it is, thereby allowing input data at a low voltage. For example, a silicon-based transistor having high mobility may be used, thereby reducing power consumption when writing data.

A drive device of an LED display according to embodiments of the present disclosure may eliminate the need for a digital-to-analog converter (DAC) for converting digital data into analog data in a data driving unit. For example, a drive device of an LED display according to embodiments of the present disclosure may apply data in a digital mode, and thus a digital-to-analog converter (DAC) is not required in a data driving unit.

A drive device of the LED display according to embodiments of the present disclosure may eliminate the need for a digital-to-analog converter (DAC) in a data driving unit, thereby reducing a size of the data driving unit.

A drive device of an LED display according to embodiments of the present disclosure may compensate for a current deviation between a current flowing through a semiconductor light emitting device applied to a sub-pixel in a display panel and a reference current.

A drive device of an LED display according to the embodiments of the present disclosure may secure a wide current range, and be applicable to a tiling display.

A drive device of an LED display according to embodiments of the present disclosure may reduce a size of a PWM generation unit that generates a digital PWM signal. For example, a shift register may be removed from a digital PWM signal generator in the related art to reduce a size of the PWM generation unit.

Those skilled in the art to which the present disclosure pertains will be able to make various modifications and variations without departing from the essential characteristics of the present disclosure. Accordingly, embodiments disclosed in the present disclosure are not intended to limit the technical concept of the present disclosure, but to explain the technical concept, and the scope of the technical concept of the present disclosure is not limited by those embodiments. The scope of protection of the present disclosure should be construed by the following claims, and all technical concepts within the scope equivalent thereto should be construed as being included in the scope of right of the present disclosure.

What is claimed is:

1. A display device comprising:

a plurality of semiconductor light-emitting devices applied to a plurality of sub-pixels included in a pixel of a display panel of the display device; and a driving unit that drives the plurality of semiconductor light-emitting devices based on a digital pulse width modulation (PWM) signal, wherein the driving unit comprises:

a current sensing unit that senses a value of a current flowing through at least one of the plurality of semiconductor light-emitting devices, a current compensation unit that compensates for a current deviation between the plurality of semiconductor-light-emitting devices based on the value of the current sensed by the current sensing unit, and a switching unit connected to each of the plurality of semiconductor light-emitting devices to switch the plurality of semiconductor light-emitting devices according to the digital PWM signal, and wherein the current compensation unit comprises a compensation unit connected between the switching unit and the ground to compensate for the current deviation between the plurality of semiconductor light-emitting devices.

2. The display device of claim 1, further comprising:

an operational amplifier that applies a difference between a voltage applied to the plurality of semiconductor light-emitting devices and a set voltage to the driving unit, wherein the current compensation unit further comprises a variable reference generator that changes the set voltage according to the value of the current sensed by the current sensing unit.

3. The display device of claim 2, wherein the current sensing unit is connected to the plurality of sub-pixels and the variable reference generator to transmit a current equal to a current flowing through at least one of the plurality of semiconductor light-emitting devices applied to the plurality of sub-pixels to the variable reference generator.

4. The display device of claim 3, wherein the variable reference generator changes the set voltage according to a deviation between a current flowing through at least one of the plurality of semiconductor light-emitting devices applied to the plurality of sub-pixels and a reference current.

5. The display device of claim 4, wherein the variable reference generator increases the set voltage when the current flowing through at least one of the plurality of semiconductor light-emitting devices applied to the sub-pixels is less than a reference current, and decreases the set voltage when the current flowing through at least one of the semiconductor light-emitting devices applied to the sub-pixels is greater than the reference current.

6. The display device of claim 4, wherein the compensation unit comprises:

a first resistor connected in series to a first switching unit that switches a first semiconductor light-emitting device among the plurality of semiconductor light-emitting devices;

a second resistor electrically connected between a point between the first switching unit and the first resistor and an input terminal of the operational amplifier;

a third resistor connected in series to a second switching unit that switches a second semiconductor light-emitting device among the plurality of semiconductor light-emitting devices; and a fourth resistor electrically connected between a point between the second switching unit and the third resistor and an input terminal of the operational amplifier.

7. The display device of claim 1, wherein the driving unit comprises a PWM generation unit that generates the digital PWM signal.

8. The display device of claim 7, wherein the PWM generation unit lacks a shift register to reduce a size of the PWM generation unit.

9. The display device of claim 1, wherein the current compensation unit compensates for the current deviation while at the same time determining a value of a current flowing through the plurality of semiconductor light-emitting devices.

10. The display device of claim 1, wherein the driving unit is a single micro-integrated circuit, and the single micro-integrated circuit drives a plurality of pixels, and each of the plurality of pixels comprises a plurality of sub-pixels.

11. The display device of claim 1, wherein the display device is driven in a digital PWM mode, and use serial digital data as is, to reduce a power supply voltage (ELVDD) for driving pixels.

12. The display device of claim 1, wherein the driving unit lacks a digital-to-analog converter (DAC) for converting digital data into analog data, so that the digital data is directly applied in a digital mode.

13. A display device comprising:

a display panel to display an image, and including pixels having sub-pixels;

a plurality of semiconductor light-emitting devices constituting the sub-pixels; and a drive device to compensate for a current deviation between the plurality of semiconductor light-emitting devices constituting the sub-pixels, wherein the driving device includes:

a driving unit that drives the plurality of semiconductor light-emitting devices based on a digital pulse width modulation (PWM) signal;

a data driving unit that generates serial digital data for driving the plurality of light-emitting diodes; and a gate driving unit that generates a driving signal for driving the plurality of light-emitting diodes in response to a scan signal.

14. The display device of claim 13, wherein the data driving unit applies the serial digital data as is to the plurality of light-emitting diodes through the driving unit, so that a digital-to-analog converter (DAC) that converts digital data into analog data is not required.

15. The display device of claim 13, wherein the driving unit comprises:

a current sensing unit that senses a value of a current flowing through at least one of the plurality of semiconductor light-emitting devices; and a current compensation unit that compensates for the current deviation between the plurality of semiconductor-light-emitting devices based on the value of the current sensed by the current sensing unit.

16. The display device of claim 15, wherein the current sensing unit detects the current flowing through at least one of the plurality of semiconductor light-emitting diodes in real time, and the current compensating unit adjusts a set voltage applied to an operational amplifier of the gate driving unit such that a preset reference current flows through any one of the plurality of semiconductor light-emitting devices so as to allow the current flowing through the at least one of the plurality of semiconductor light-emitting diodes to become the preset reference current when the sensed value of the current is different from the preset reference current.

17. The display device of claim 15, wherein the driving unit lacks a digital-to-analog converter (DAC) for converting digital data into analog data, so that the digital data is directly applied to the plurality semiconductor light-emitting diodes in a digital mode.

18. The display device of claim 15, wherein the driving unit further comprises a switching unit connected to each of the plurality of semiconductor light-emitting devices to switch the plurality of semiconductor light-emitting devices according to the digital PWM signal, and wherein the current compensation unit comprises a compensation unit connected between the switching unit and the ground to compensate for the current deviation between the plurality of semiconductor light-emitting devices.

19. The display device of claim 18, further comprising:

an operational amplifier that applies a difference between a voltage applied to the plurality of semiconductor light-emitting devices and a set voltage to the driving unit, wherein the current compensation unit further comprises a variable reference generator that changes the set voltage according to the value of the current sensed by the current sensing unit.

20. A display device comprising:

a plurality of semiconductor light-emitting devices applied to a plurality of sub-pixels included in a pixel of a display panel of the display device; and a driving unit that drives the plurality of semiconductor light-emitting devices based on a digital pulse width modulation (PWM) signal, wherein the driving unit comprises:

a current sensing unit that senses a value of a current flowing through at least one of the plurality of semiconductor light-emitting devices; and a current compensation unit that compensates for a current deviation between the plurality of semiconductor-light-emitting devices based on the value of the current sensed by the current sensing unit, wherein the driving unit lacks a digital-to-analog converter (DAC) for converting digital data into analog data, so that the digital data is directly applied in a digital mode.

* * * * *